US010685805B2

(12) United States Patent
Rozman

(10) Patent No.: US 10,685,805 B2
(45) Date of Patent: Jun. 16, 2020

(54) GAS DISCHARGE TUBE ASSEMBLIES

(71) Applicant: RIPD IP DEVELOPMENT LTD, Nicosia (CY)

(72) Inventor: Robert Rozman, Smlednik (SI)

(73) Assignee: RIPD IP DEVELOPMENT LTD, Nicosia (CY)

( * ) Notice: Subject to any disclaimer, the term of this patent is extended or adjusted under 35 U.S.C. 154(b) by 0 days.

(21) Appl. No.: 16/667,939

(22) Filed: Oct. 30, 2019

(65) Prior Publication Data

US 2020/0161073 A1 May 21, 2020

Related U.S. Application Data

(60) Provisional application No. 62/767,917, filed on Nov. 15, 2018, provisional application No. 62/864,867, filed on Jun. 21, 2019.

(51) Int. Cl.

| | |
|---|---|
| ***H01J 11/22*** | (2012.01) |
| ***H01T 2/02*** | (2006.01) |
| ***H01T 4/16*** | (2006.01) |

(52) U.S. Cl.

CPC ..... *H01J 11/22* (2013.01); *H01T 2/02* (2013.01); *H01T 4/16* (2013.01); *H01J 2211/245* (2013.01); *H01J 2893/0065* (2013.01)

(58) Field of Classification Search

CPC ..... H01J 11/22; H01J 2893/0065; H01J 2211/245; H01T 4/16; H01T 2/02

See application file for complete search history.

(56) References Cited

U.S. PATENT DOCUMENTS

| | | | |
|---|---|---|---|
| 2,326,074 | A | 8/1943 | Slepian |
| 2,365,518 | A | 12/1944 | Berkey et al. |
| 2,562,692 | A | 7/1951 | Bigwood |
| 4,158,869 | A | 6/1979 | Gilberts |
| 4,190,733 | A | 2/1980 | Wootton |
| 4,491,893 | A | 1/1985 | Toda |

(Continued)

FOREIGN PATENT DOCUMENTS

| | | | |
|---|---|---|---|
| CZ | 12200 | U1 | 6/2002 |
| DE | 19755082 | A1 | 6/1999 |

(Continued)

OTHER PUBLICATIONS

"Gas Discharge Tubes—GDT" Iskra Zašcite (2 pages) (Jul. 4, 2014).

(Continued)

*Primary Examiner* — Kevin Quarterman
(74) *Attorney, Agent, or Firm* — Myers Bigel, P.A.

(57) ABSTRACT

A gas discharge tube assembly includes a multi-cell gas discharge tube (GDT). The multi-cell GDT includes a housing defining a GDT chamber, a plurality of inner electrodes located in the GDT chamber, a trigger resistor located in the GDT chamber, and a gas contained in the GDT chamber. The inner electrodes are serially disposed in the chamber in spaced apart relation to define a series of cells and spark gaps. The trigger resistor includes an interface surface exposed to at least one of the cells. The trigger resistor is responsive to an electrical surge through the trigger resistor to generate a spark along the interface surface and thereby promote an electrical arc in the at least one cell.

25 Claims, 30 Drawing Sheets

(56) References Cited

U.S. PATENT DOCUMENTS

| | | | | |
|---|---|---|---|---|
| 5,493,469 | A | 2/1996 | Lace | |
| 7,053,536 | B1 | 5/2006 | Boman et al. | |
| 7,570,473 | B2 | 8/2009 | Adachi et al. | |
| 7,604,754 | B2 | 10/2009 | Summers | |
| 7,643,265 | B2 | 1/2010 | Loader et al. | |
| 7,660,095 | B2 | 2/2010 | Shato et al. | |
| 7,719,815 | B2 | 5/2010 | Shato et al. | |
| 7,937,825 | B2 | 5/2011 | Shato et al. | |
| 10,186,842 | B2 | 1/2019 | Rozman | |
| 10,319,545 | B2 | 6/2019 | Kamensek et al. | |
| 10,340,110 | B2 | 7/2019 | Vrhunc et al. | |
| 2005/0168889 | A1* | 8/2005 | Halvarsson | H01T 2/02 361/2 |
| 2013/0278129 | A1* | 10/2013 | Krauss | H01T 4/16 313/10 |
| 2014/0092514 | A1 | 4/2014 | Chen | |
| 2017/0288371 | A1 | 10/2017 | Rozman | |
| 2018/0151318 | A1 | 5/2018 | Kamensek et al. | |
| 2018/0330908 | A1 | 11/2018 | Vrhunc et al. | |
| 2019/0080826 | A1 | 3/2019 | Kamensek et al. | |
| 2019/0252142 | A1 | 8/2019 | Kamensek et al. | |
| 2019/0267206 | A1 | 8/2019 | Vrhunc et al. | |
| 2020/0036185 | A1 | 1/2020 | Tsovilis et al. | |

FOREIGN PATENT DOCUMENTS

| | | | |
|---|---|---|---|
| DE | 29724817 | U1 | 4/2004 |
| DE | 102011102864 | A1 | 4/2012 |
| EP | 0905840 | A1 | 3/1999 |
| EP | 1075064 | A1 | 2/2001 |
| EP | 2573885 | A1 | 3/2013 |
| FR | 2451628 | A1 | 10/1980 |
| FR | 2991117 | A3 | 12/2014 |
| GB | 352756 | A | 7/1931 |
| WO | 2010/086286 | A1 | 8/2010 |
| WO | 2017/129291 | A1 | 8/2017 |

OTHER PUBLICATIONS

"Gas-filled tube" Wikipedia, Retrieved from: http://en.wikipedia.org/wiki/Gas-filled_tube (9 pages) (Retrieved on: Jan. 20, 2015).

Translation of DIN-Standards, Built-In Equipment for Electrical Installations; Overall Dimensions and Related Mounting Dimensions (15 pages) (Dec. 1988).

Extended European Search Report corresponding to European Application No. 19208234.5 (8 pages) (dated Apr. 1, 2020).

* cited by examiner

GAS DISCHARGE TUBE ASSEMBLIES

RELATED APPLICATION(S)

The present application claims the benefit of and priority from U.S. Provisional Patent Application No. 62/767,917, filed Nov. 15, 2018, and U.S. Provisional Patent Application No. 62/864,867, filed Jun. 21, 2019, the disclosures of which are incorporated herein by reference in their entireties.

FIELD OF THE INVENTION

The present invention relates to circuit protection devices and, more particularly, to overvoltage protection devices and methods.

BACKGROUND OF THE INVENTION

Frequently, excessive voltage or current is applied across service lines that deliver power to residences and commercial and institutional facilities. Such excess voltage or current spikes (transient overvoltages and surge currents) may result from lightning strikes, for example. The above events may be of particular concern in telecommunications distribution centers, hospitals and other facilities where equipment damage caused by overvoltages and/or current surges and resulting down time may be very costly.

SUMMARY OF THE INVENTION

According to some embodiments, a gas discharge tube assembly includes a multi-cell gas discharge tube (GDT). The multi-cell GDT includes a housing defining a GDT chamber, a plurality of inner electrodes located in the GDT chamber, a trigger resistor located in the GDT chamber, and a gas contained in the GDT chamber. The inner electrodes are serially disposed in the chamber in spaced apart relation to define a series of cells and spark gaps. The trigger resistor includes an interface surface exposed to at least one of the cells. The trigger resistor is responsive to an electrical surge through the trigger resistor to generate a spark along the interface surface and thereby promote an electrical arc in the at least one cell.

In some embodiments, the multi-cell GDT includes first and second trigger end electrodes, the series of cells and spark gaps extends from the first trigger end electrode to the second trigger end electrode, and the trigger resistor electrically connects the first trigger end electrode to the second trigger end electrode.

In some embodiments, the trigger resistor is exposed to a plurality of the cells and is responsive to an electrical surge through the trigger resistor to generate sparks along the interface surface and thereby promote electrical arcs in the plurality of the cells.

In some embodiments, the multi-cell GDT has a main axis and the inner electrodes and the first and second trigger end electrodes are spaced apart along the main axis, and the trigger resistor is configured as an elongate strip extending along the main axis.

According to some embodiments, the multi-cell GDT includes a plurality of the trigger resistors extending along the main axis and each having an interface surface, and each of the trigger resistors is exposed to a plurality of the cells and is responsive to an electrical surge through the trigger resistor to generate sparks along the interface surface thereof and thereby promote electrical arcs in the plurality of the cells.

In some embodiments, the gas discharge tube assembly includes a trigger device. The trigger device includes a trigger device substrate including an axially extending groove defined therein, and the trigger resistor. The trigger resistor is disposed in the groove such that the interface layer is exposed.

According to some embodiments, the trigger device substrate includes a plurality axially extending, substantially parallel grooves defined therein, and the trigger device includes a plurality of the trigger resistors each disposed in a respective one of the grooves.

In some embodiments, the gas discharge tube assembly further includes an outer resistor that electrically connects the first trigger end electrode to the second trigger end electrode, and is not exposed to the cells.

In some embodiments, the outer resistor is mounted on an exterior of the housing.

According to some embodiments, the trigger resistor includes an inner surface facing the inner electrodes and including the interface surface, and the gas discharge tube assembly further includes an electrically insulating resistor protection layer bonded to the inner surface between the inner surface and the inner electrodes.

According to some embodiments, the gas discharge tube assembly includes an integral primary GDT connected in series with the multi-cell GDT. The primary GDT is operative to conduct current in response to an overvoltage condition across the gas discharge tube assembly and prior to conduction of current across the plurality of spark gaps of the multi-cell GDT.

In some embodiments, the primary GDT is electrically connected to the trigger resistor such that current is conducted through the trigger resistor when the primary GDT conducts current.

According to some embodiments, the primary GDT is located in the GDT chamber, and the GDT chamber is hermetically sealed.

In some embodiments, the GDT chamber is hermetically sealed, the primary GDT includes a primary GDT chamber that is hermetically sealed from the GDT chamber, and the primary GDT chamber contains a primary GDT gas that is different from the gas in the GDT chamber.

According to some embodiments, the GDT chamber is hermetically sealed.

In some embodiments, the housing includes a tubular housing insulator, and at least one reinforcement member positioned in the housing insulator between the inner electrodes and the housing insulator.

According to some embodiments, the at least one reinforcement member includes a plurality of locator slots, and the inner electrodes are each seated in a respective one of the locator slots such that the inner electrodes are thereby held in axially spaced apart relation and are able to move laterally a limited displacement distance.

According to some embodiments, the inner electrodes are substantially flat plates.

In some embodiments, the trigger resistor is formed of a material having a specific electrical resistance in the range of from about 0.1 micro-ohm-meter to 10,000 ohm-meter.

In some embodiments, the trigger resistor has an electrical resistance in the range of from about 0.1 ohm to 100 ohms.

According to some embodiments, the interface surface of the trigger resistor is nonhomogeneous and porous.

In some embodiments, the multi-cell GDT has a main axis and the inner electrodes are spaced apart along the main axis, the trigger resistor extends along the main axis, a plurality of laterally extending, axially spaced apart surface grooves are defined in the interface surfaces of the trigger resistor, and the surface grooves do not extend fully through a thickness of the trigger resistor, so that a remainder portion of the trigger resistor is present at the base of each surface groove and provides electrical continuity throughout a length of the trigger resistor.

According to some embodiments, each surface groove has an axially extending width in the range of from about 0.2 mm to 1 mm.

In some embodiments, the gas discharge tube assembly includes a thermal disconnect mechanism responsive to heat generated in the gas discharge tube assembly to disconnect the gas discharge tube assembly from a circuit.

In some embodiments, the gas discharge tube assembly includes an integral test gas discharge tube (GDT). The test GDT includes a test GDT electrode and a test GDT chamber. The test GDT chamber is in fluid communication with the GDT chamber to permit flow of the gas between the GDT chamber and the test GDT chamber.

DETAILED DESCRIPTION OF EMBODIMENTS OF THE INVENTION

Figure 1:
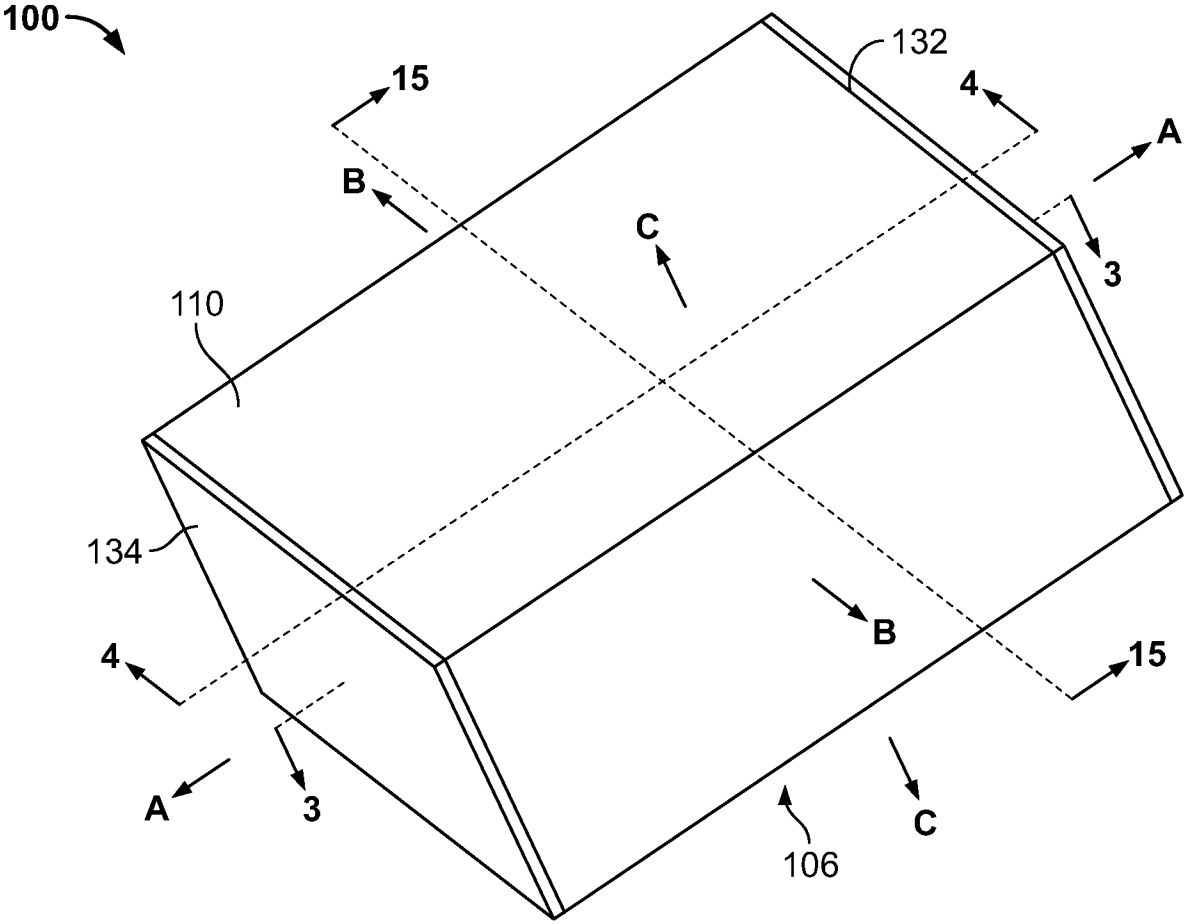
FIG. 1 is a perspective view of a GDT assembly according to some embodiments.
Figure 2:
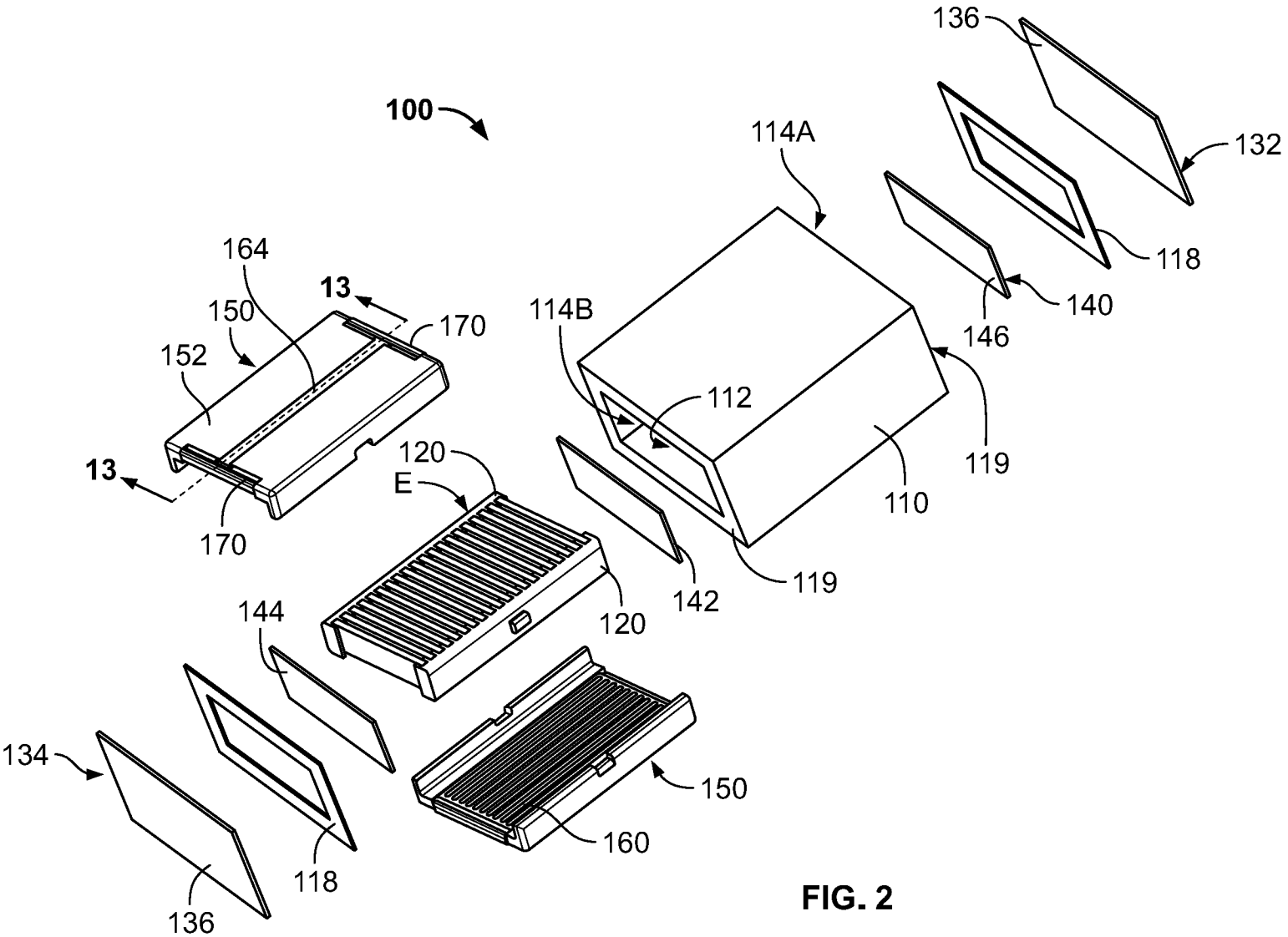
FIG. 2 is an exploded, perspective view of the GDT assembly of FIG. 1.
Figure 4:
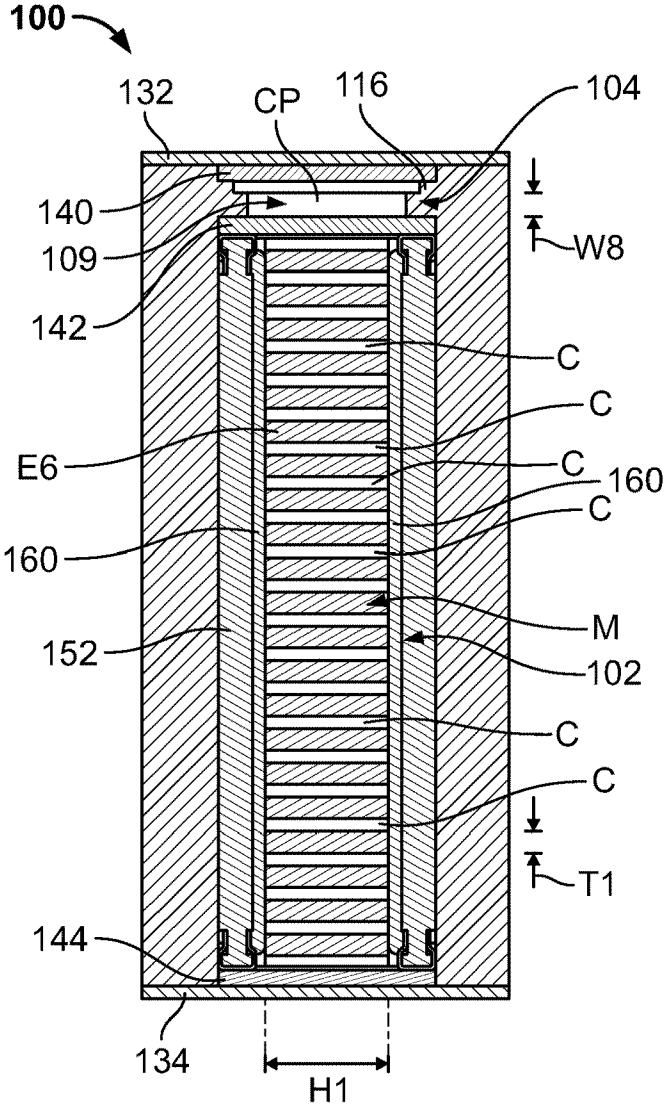
FIG. 4 is a cross-sectional view of the GDT assembly of FIG. 1 taken along the line 4-4 of FIG. 1.
Figure 3:
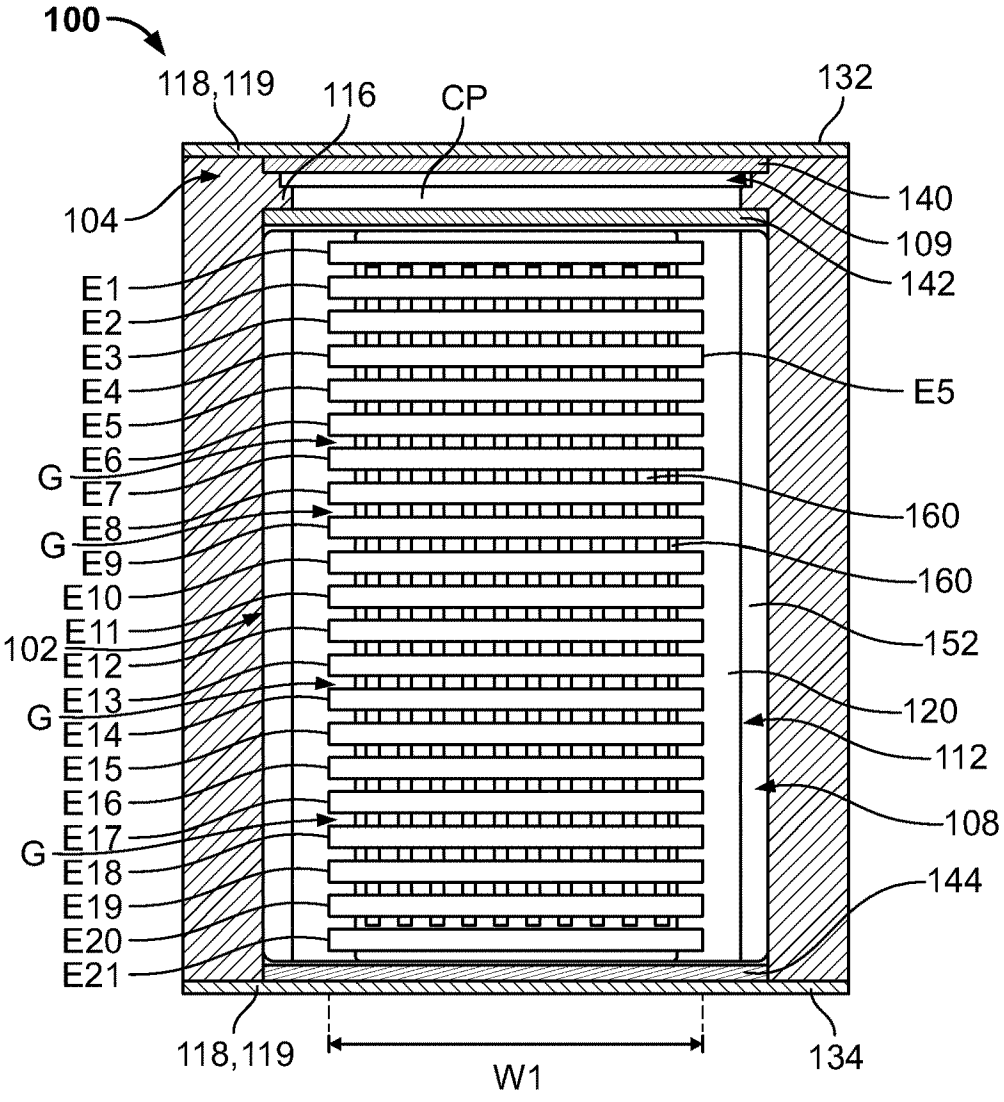
FIG. 3 is a cross-sectional view of the GDT assembly of FIG. 1 taken along the line 3-3 of FIG. 1.
Figure 6:
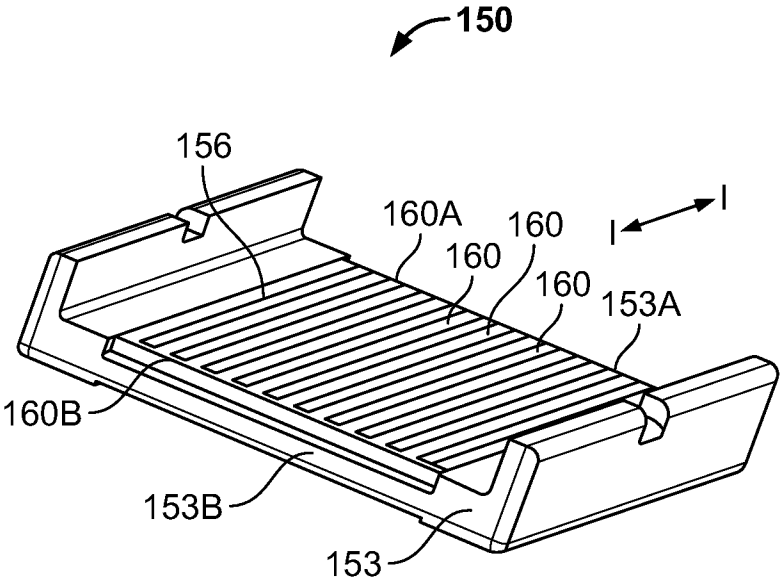
FIG. 6 is a fragmentary, perspective view of the trigger device forming a part of the GDT assembly of FIG. 1.
Figure 5:
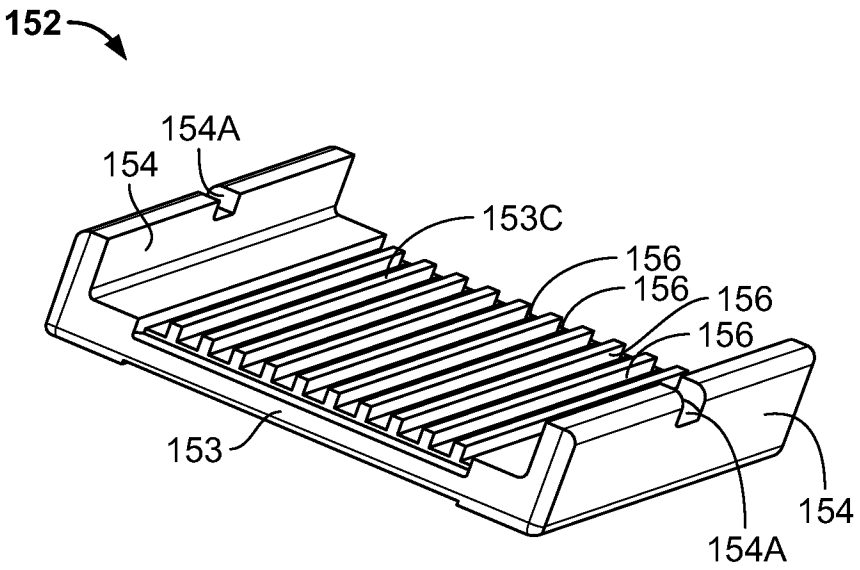
FIG. 5 is a perspective view of a trigger device substrate forming a part of the GDT assembly of FIG. 1.
Figure 7:
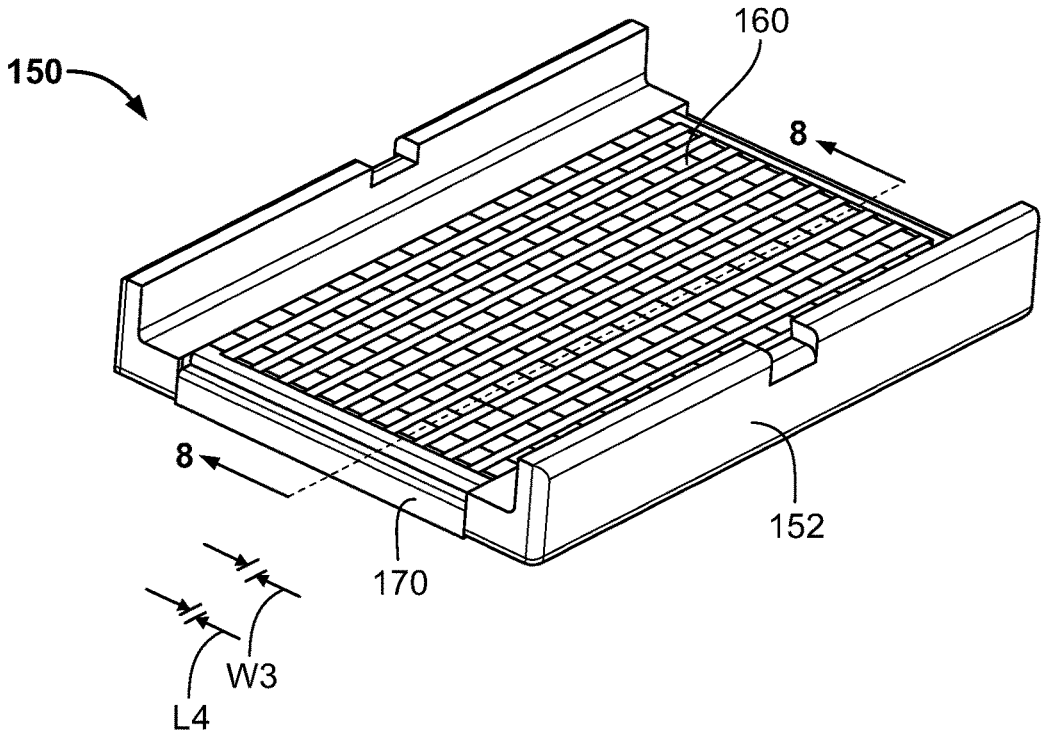
FIG. 7 is a perspective view of the trigger device forming a part of the GDT assembly of FIG. 1.
Figure 8:
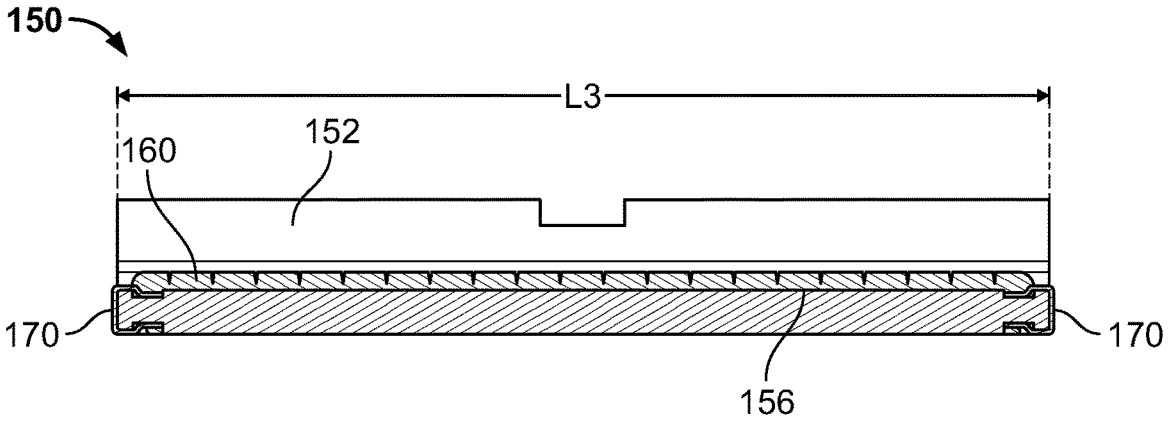
FIG. 8 is a cross-sectional view of the trigger device of FIG. 7 taken along the line 8-8 of FIG. 7.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, a "hermetic seal" is a seal that prevents the passage, escape or intrusion of air or other gas through the seal (i.e., airtight). "Hermetically sealed" means that the described void or structure (e.g., chamber) is sealed to prevent the passage, escape or intrusion of air or other gas into or out of the void or structure.

As used herein, "monolithic" means an object that is a single, unitary piece formed or composed of a material without joints or seams.

With reference to FIGS. 1-16, a modular, multi-cell gas arrestor or gas discharge tube (GDT) assembly 100 according to embodiments of the invention is shown therein. The GDT 100 includes a housing insulator 110, a first outer or terminal electrode 132, a second outer or terminal electrode 134, a primary GDT end electrode 140, a first trigger end electrode 142, a second trigger end electrode 144, a set E of inner electrodes E1-E21, seals 118, bonding layers 119, a pair of locator members 120, a bonding agent 128, a pair of trigger covers or devices 150, and a selected gas M.

As discussed in more detail below, the GDT assembly 100 includes a separated or primary GDT 104 and a multi-cell main or secondary GDT 102.

The trigger devices 150 and the trigger end electrodes 142, 144 together form a trigger system 141.

The housing insulator 110 is generally tubular and has axially opposed end openings 114A, 114B communicating with a through passage or cavity 112. The housing insulator 110 also includes an annular locator flange 116 proximate, but axially spaced apart from, the opening 114A. The housing insulator 110 and the cavity 112 are rectangular in cross-section.

The housing insulator 110 may be formed of any suitable electrically insulating material. According to some embodiments, the insulator 110 is formed of a material having a melting temperature of at least 1000 degrees Celsius and, in some embodiments, at least 1600 degrees Celsius. In some embodiments, the insulator 110 is formed of a ceramic. In some embodiments, the insulator 110 includes or is formed of alumina ceramic ($Al_2O_3$) and, in some embodiments, at least about 90% $Al_2O_3$. In some embodiments, the insulator 110 is monolithic.

The housing insulator 110 and the terminal electrodes 132, 134 collectively form an enclosure or housing 106 defining an enclosed GDT chamber 108. The chamber 108 is rectangular in cross-section. The inner electrodes E1-E21, the locator members 120, the electrodes 140, 142, 144, the trigger devices 150, and the gas M are contained in the chamber 108. The trigger end electrode 142 divides the GDT chamber 108 into a secondary chamber 108A and a primary GDT chamber 109.

The housing 106 has a central lengthwise or main axis A-A, a first lateral or widthwise axis B-B perpendicular to the axis A-A, and a second lateral or heightwise axis C-C perpendicular to the axes A-A and B-B.

The first terminal electrode 132 is mounted in intimate electrical contact with the primary GDT end electrode 140. As discussed hereinbelow, the electrodes 142, E1-E21, and 144 are axially spaced apart to define a plurality of gaps G (twenty-two gaps G) and a plurality of cells C (twenty-two cells C) between the electrodes 142, E1-E21, and 144. Additionally, the primary GDT end electrode 140 and the first trigger end electrode 142 are axially spaced apart to define a primary GDT gap GP and a primary GDT cell CP between the electrodes 140 and 142. The electrodes 140, 142, E1-E21, and 144, the gaps G, GP, and the cells C, CP are serially distributed in spaced apart relation along the axis A-A.

Each locator member 120 includes a body 122 having a plurality of integral ribs defining locator slots 124. Opposed integral locator protrusions 126 project laterally outward from the body 122.

The locator members 120 may be formed of any suitable electrically insulating material. According to some embodiments, the locator members 120 are formed of a material having a melting temperature of at least 1000 degrees Celsius and, in some embodiments, at least 1600 degrees Celsius. In some embodiments, each locator member 120 is formed of a ceramic. In some embodiments, each locator member 120 includes or is formed of alumina ceramic ($Al_2O_3$) and, in some embodiments, at least about 90% $Al_2O_3$. In some embodiments, each locator member 120 is monolithic.

The terminal electrodes 132, 134 are substantially flat plates each having opposed, substantially parallel planar surfaces 136. The electrodes 132, 134 may be formed of any suitable material. According to some embodiments, the electrodes 132, 134 are formed of metal and, in some embodiments, are formed of molybdenum or Kovar. According to some embodiments, each of the electrodes 132, 134 is unitary and, in some embodiments, monolithic.

The terminal electrodes 132, 134 are secured and sealed by the bonding layers 119 over and covering the openings 114A, 114B. The bonding layers 119 along with the seals 118 thereby hermetically seal the openings 114A, 114B. In some embodiments, the bonding layers 119 are metallization, solder or metal-based layers. Suitable metal-based materials for forming the bonding layers 119 may include nickel-plated Ma-Mo metallization. Suitable materials for the seals 118 may include a brazing alloy such as silver-copper alloy.

The trigger end electrodes 142, 144 are substantially flat plates each having opposed, substantially parallel planar surfaces 146. The electrodes 142, 144 may be formed of any suitable material. According to some embodiments, the electrodes 142, 144 are formed of metal and, in some embodiments, are formed of molybdenum or Kovar. According to some embodiments, each of the electrodes 142, 144 is unitary and, in some embodiments, monolithic.

The primary GDT end electrode 140 is a substantially flat plate having opposed, substantially parallel planar surfaces 146. The electrode 140 may be formed of any suitable material. According to some embodiments, the electrodes 140 is formed of metal and, in some embodiments, is formed of molybdenum or Kovar. According to some embodiments, the electrode 140 is unitary and, in some embodiments, monolithic.

The inner electrodes E1-E21 are substantially flat plates with opposed planar faces 137.

According to some embodiments, each of the electrodes E1-E21 has a thickness T1 (FIG. 4) in the range of from about 0.5 to 1 mm and, in some embodiments, in the range of from about 0.8 to 1.5 mm. According to some embodiments, each electrode E1-E21 has a height H1 in the range of from about 4 to 10 mm and, in some embodiments, in the range of from 8 to 20 mm. According to some embodiments, the width W1 of each electrode E1-E21 is in the range of from about 4 to 30 mm.

The electrodes E1-E21 may be formed of any suitable material. According to some embodiments, the electrodes E1-E21 are formed of metal and, in some embodiments, are formed of molybdenum, copper, tungsten or steel. According to some embodiments, each of the electrodes E1-E21 is unitary and, in some embodiments, monolithic.

The side edges of the electrodes E1-E21 are seated in opposed slots 124 of the locator members 120, and the electrodes E1-E21 are thereby semi-fixed or floatingly mounted in the chamber 108. As discussed above, the inner electrodes E1-E21 are serially positioned and distributed in the chamber 108 along the axis A-A. The electrodes E1-E21 are positioned such that each electrode E1-E21 is physically spaced apart from the immediately adjacent other inner electrode(s) E1-E21. The locator members 120 thereby limit axial displacement (along the axis A-A) and lateral displacement (along the axis B-B) of each electrode E1-E21 relative to the housing 106. Each electrode E1-E21 is also captured between the trigger devices 150 to thereby limit lateral displacement (along axis C-C) of the electrode E1-E14 relative to the housing 106.

The primary GDT end electrode 140 is secured in position by and axially captured between the locator flange 116 and the first terminal electrode 132.

The first trigger end electrode 142 is secured in position by and axially captured between the locator flange 116 and the ends of the locator members 120 and the trigger devices 150. The first trigger end electrode 142 is thereby axially spaced apart from the primary GDT end electrode 140.

In this manner, each electrode 140, 142, E1-E21, and 144 is positively positioned and retained in position relative to the housing 106 and the other electrodes 140, 142, E1-E21, and 144. In some embodiments, the electrodes 140, 142, E1-E21, and 144 are secured in this manner without the use of additional bonding or fasteners applied to the electrodes E1-E21 or, in some embodiments, to the electrodes 140, 142, E1-E21, and 144. The electrodes 140, 142, E1-E21, and 144 may be semi-fixed or loosely captured between the housing insulator 110, the locator members 120, and the trigger devices 150. The electrodes 140, 142, E1-E21, and 144 may be capable of floating relative to the housing insulator 110, the locator members 120, and/or the trigger devices 150 along one or more of the axes A-A, B-B, C-C to a limited degree within the housing 106.

The trigger covers or devices 150 may be constructed in the same manner. One of the trigger devices 150 will be described below, it being understood that this description likewise applies to the other trigger device 150.

Each trigger device 150 includes a substrate 152, a plurality of inner trigger resistor layers or resistors 160, an outer supplemental resistor layer or resistor 164, and a pair of metal contacts 170.

The substrate 152 includes a secondary wall or body 153 and a pair of laterally opposed integral flanges 154. A recess 154A is defined in each flange 154. Axially extending inner recesses or grooves 156 are defined in the inner side of the body 153. An axially extending outer recess or groove 158 is defined in the outer side of the body 153. The body 153 has axially opposed end edges 153A, 153B. The grooves 156, 158 each extend from edge 153A to edge 153B.

The substrate 152 may be formed of any suitable electrically insulating material. According to some embodiments, the substrate 152 is formed of a material having a melting temperature of at least 1000 degrees Celsius and, in some embodiments, at least 1600 degrees Celsius. In some embodiments, the substrate 152 is formed of a ceramic. In some embodiments, the substrate 152 includes or is formed of alumina ceramic ($Al_2O_3$) and, in some embodiments, at least about 90% $Al_2O_3$. In some embodiments, the substrate 152 is monolithic.

Each inner trigger resistor 160 is an elongate layer or strip having a lengthwise axis I-I, which may be substantially parallel to the axis A-A. The opposed ends 160A and 160B of each resistor 160 are located at the end edges 153A and 153B, respectively, of the substrate 152 so that each resistor 160 is substantially axially coextensive with the body 153. Each resistor 160 extends continuously from end 160A to end 160B and from end 153A to end 153B. Each resistor 160 is seated in a respective one of the grooves 156 such that an inner interface surface 161 of the resistor 160 is substantially coplanar with an inner surface 153C of the body 153.

As discussed below, each trigger resistor 160 includes a plurality of axially spaced apart and serially distributed surface grooves 162 defined in the interface surface 161 of the resistor 160. The grooves 162 extend lengthwise transverse to the axis I-I. The grooves 162 do not extend through the full thickness T3 of the resistors 160, so that a remainder portion 163 of each resistor 160 remains at the bottom of each groove 162. The remainder portions 163 provide continuity throughout the length of the resistor 160.

The trigger resistors 160 may be formed of any suitable electrically resistive material. According to some embodiments, the inner resistors 160 are formed of a mixture of aluminum and glass. However, the resistors 160 may be formed of any other suitable electrically resistive material.

According to some embodiments, the trigger resistors 160 are formed of a material having a specific electrical resistance in the range of from about 0.1 micro-ohm-meter to 10,000 ohm-meter.

According to some embodiments, each of the trigger resistors 160 has an electrical resistance in the range of from about 0.1 to 100 ohms.

According to some embodiments, each of the trigger resistors 160 has a cross-sectional area (in the plane defined by axes B-B and C-C) in the range of from about 0.1 to 10 $mm^2$.

According to some embodiments, each of the trigger resistors 160 has a length L3 (FIG. 8) in the range of from about 3 to 50 mm.

According to some embodiments, each of the trigger resistors 160 has a thickness T3 (FIG. 9) in the range of from about 0.1 to 3 mm.

According to some embodiments, each of the trigger resistors 160 has a width W3 (FIG. 7) in the range of from about 0.2 to 20 mm.

According to some embodiments, the width W4 (FIG. 9) of each groove 162 is in the range of from about 0.2 mm to 1 mm and, in some embodiments, is in the range of from about 0.02 to 0.3 mm.

Figure 9:
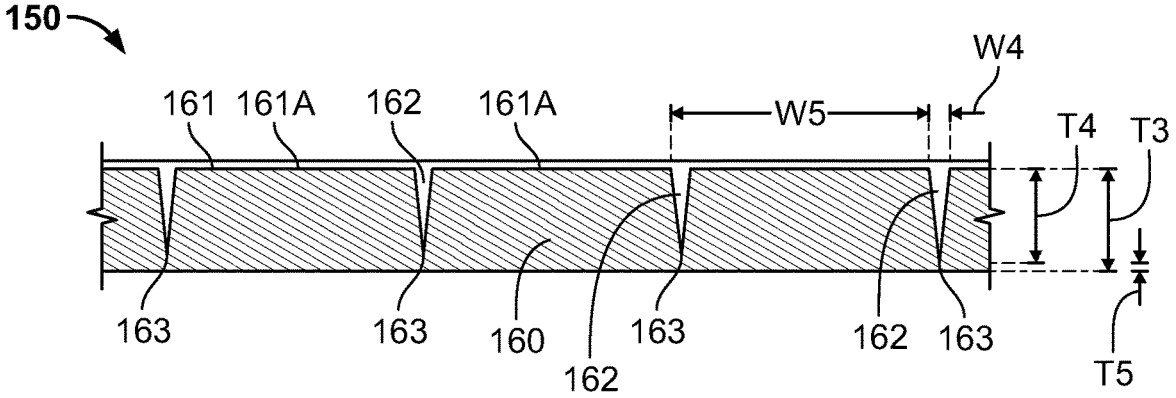
FIG. 9 is an enlarged, fragmentary, cross-sectional view of the trigger device of FIG. 7 taken along the line 8-8 of FIG. 7.
Figure 10:
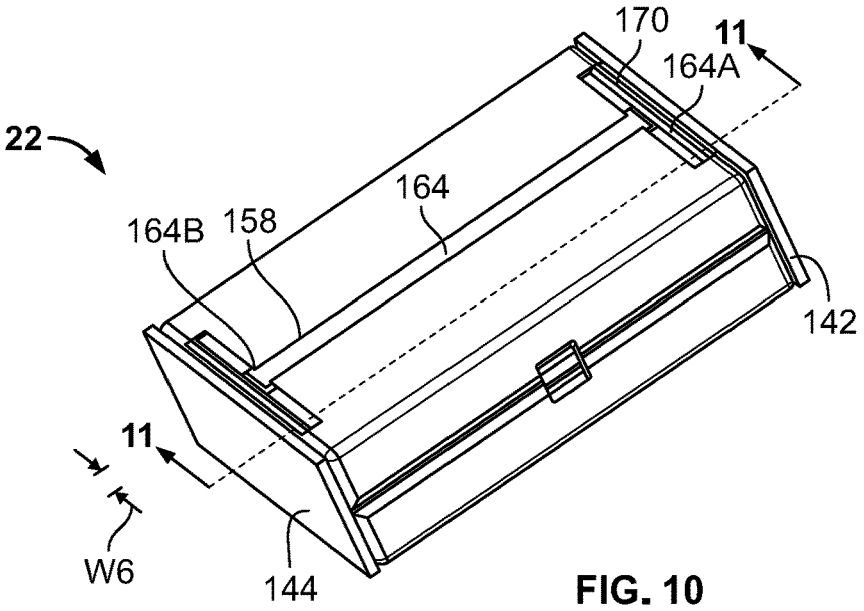
FIG. 10 is a fragmentary, perspective view of the GDT assembly of FIG. 1.
Figure 11:
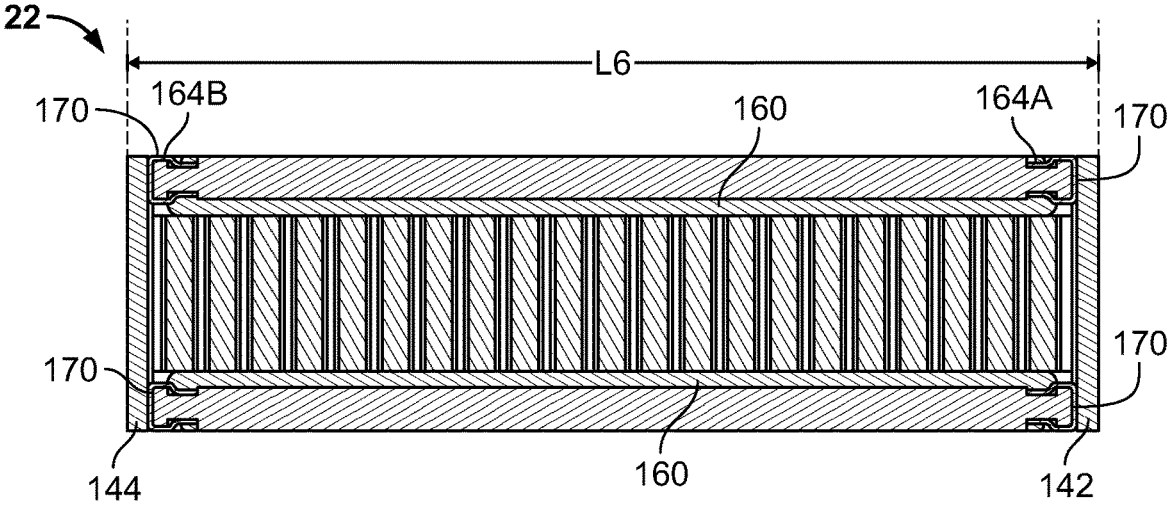
FIG. 11 is a cross-sectional view of the GDT assembly of FIG. 10 taken along the line 11-11 of FIG. 10.
Figure 12:
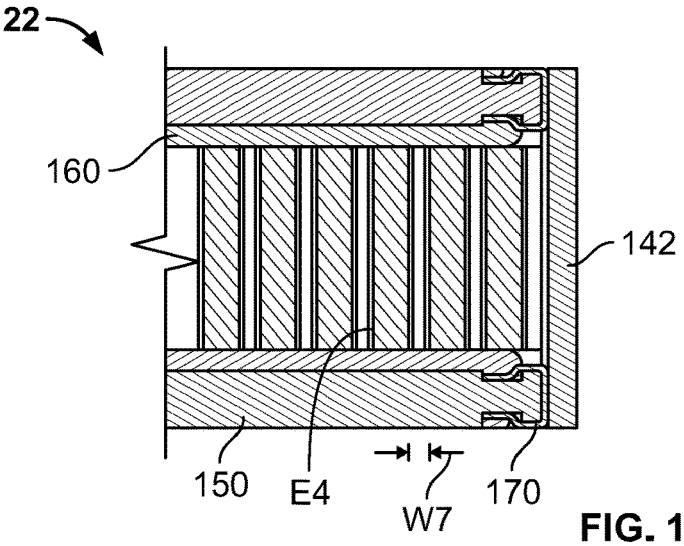
FIG. 12 is an enlarged, fragmentary, cross-sectional view of the GDT assembly of FIG. 10 taken along the line 11-11 of FIG. 10.
Figure 13:
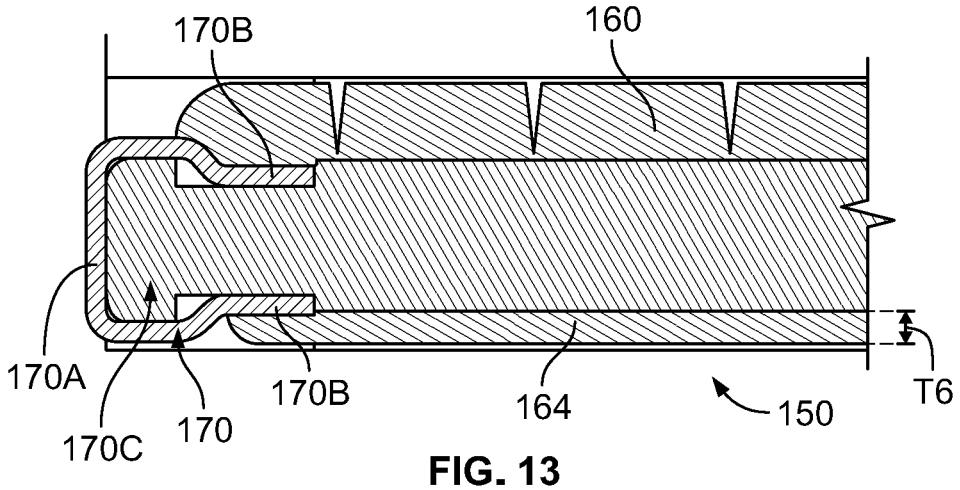
FIG. 13 is an enlarged, fragmentary, cross-sectional view of the trigger device of FIG. 7 taken along the line 13-13 of FIG. 2.
Figure 14:
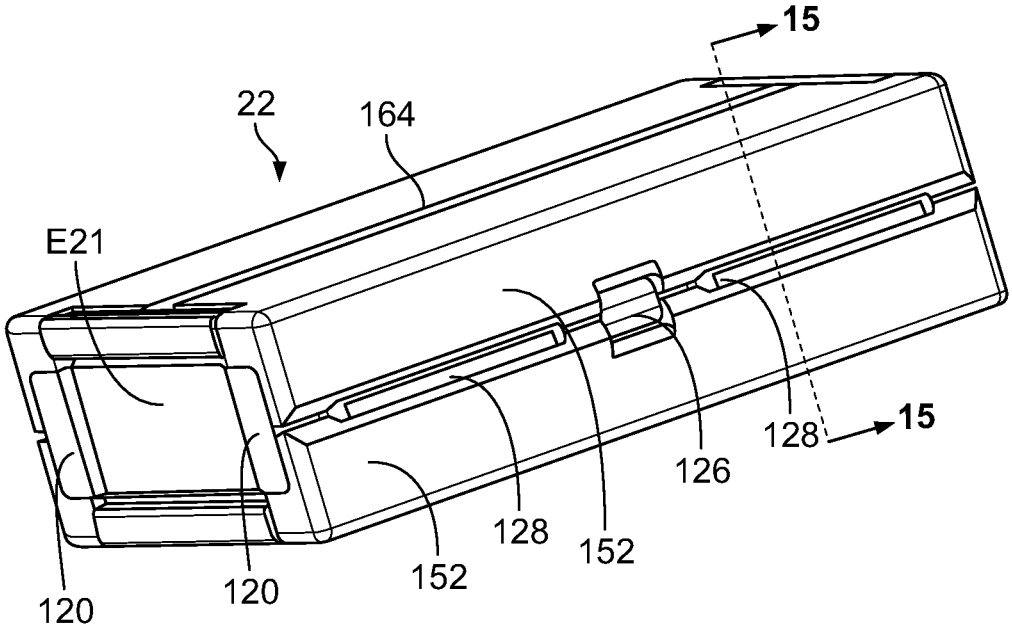
FIG. 14 is a perspective view of a subassembly forming a part of the GDT assembly of FIG. 1.
Figure 15:
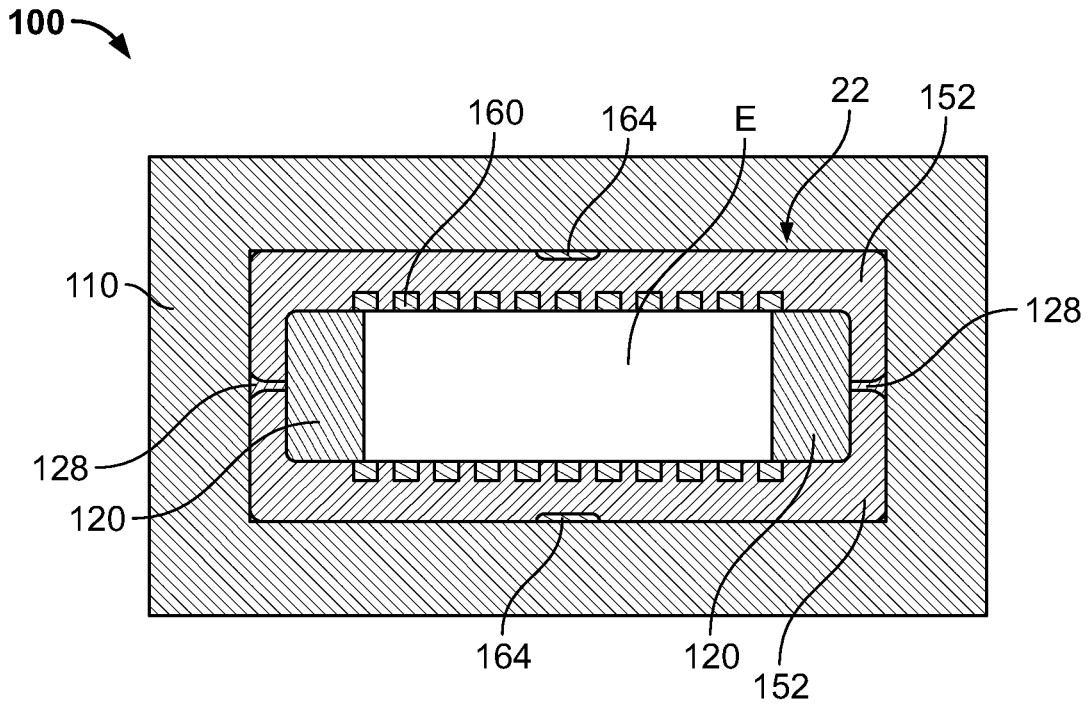
FIG. 15 is a cross-sectional view of the GDT assembly of FIG. 1 taken along the line 15-15 of FIG. 1.
Figure 16:
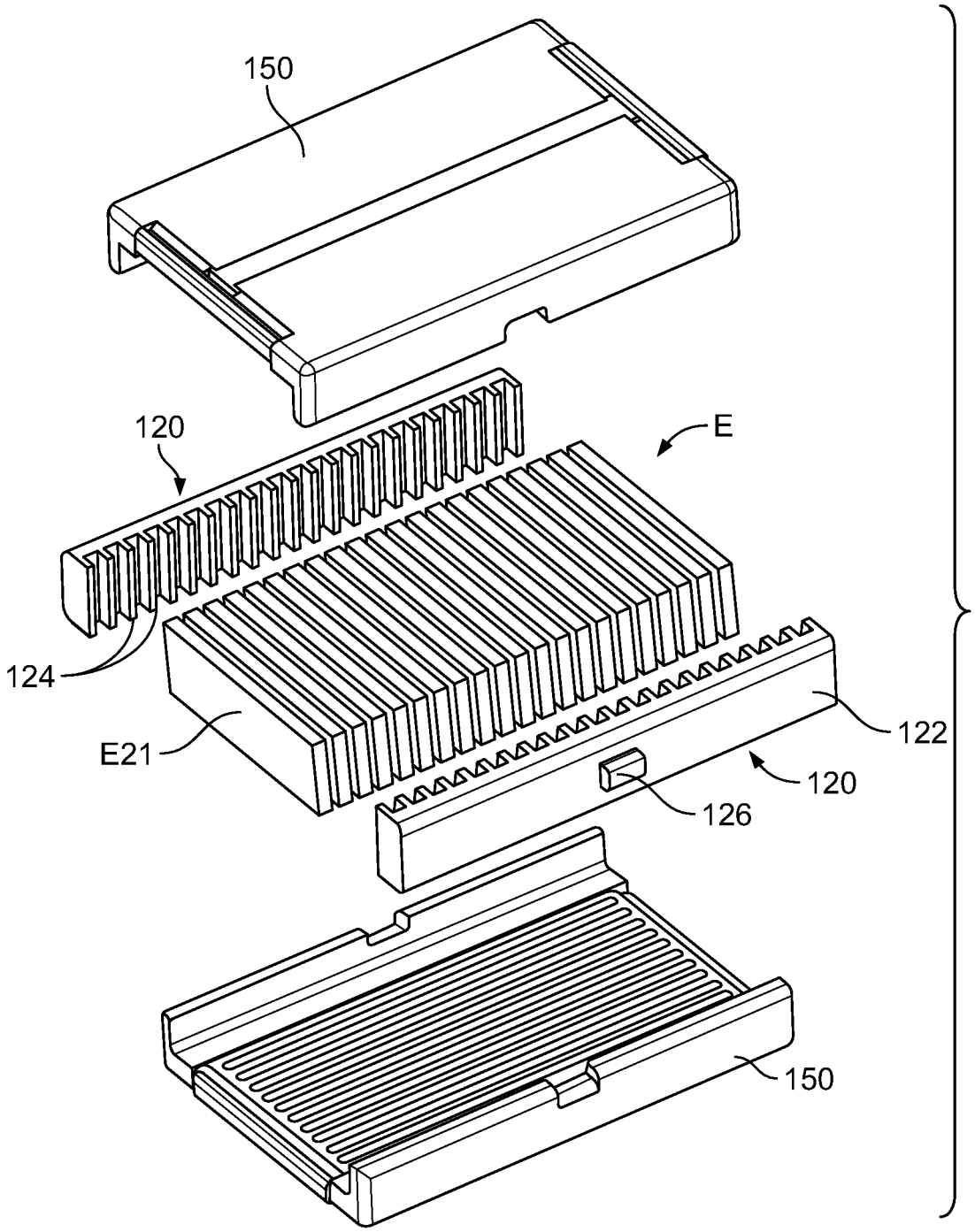
FIG. 16 is an exploded, fragmentary view of the GDT assembly of FIG. 1.

According to some embodiments, the length L4 of each groove 162 extends across the entire width W3 of its resistor 160. In this case, the grooves 162 divide or partition the interface surface 161 into a series of discrete interface surface sections 161A (FIG. 9).

According to some embodiments, each groove 162 has a depth T4 (FIG. 9) in the range of from about 0.1 to 2 mm. According to some embodiments, each remainder portion 163 has a thickness T5 (FIG. 9) in the range of from about 0.2 to 1 mm.

According to some embodiments, the spacing W5 (FIG. 9) between each adjacent groove 162 is in the range of from about 0.3 to 7 mm.

The outer resistor 164 is an elongate layer or strip having a lengthwise axis J-J, which may be substantially parallel to the axis A-A. The opposed ends 164A and 164B of the resistor 164 are located at the end edges 153A and 153B, respectively, of the substrate 152 so that the resistor 164 is substantially axially coextensive with the body 153. The resistor 164 extends continuously from end 164A to end 164B and from end 153A to end 153B. The resistor 164 is seated in the outer groove 158.

The outer resistor 164 may be formed of any suitable electrically resistive material. According to some embodiments, the outer resistor 164 is formed of a mixture of aluminum and glass. The resistor 164 may be formed of other suitable electrically resistive materials.

According to some embodiments, the outer resistor 164 is formed of a material having a specific electrical resistance in the range of from about 5 ohm-meter to 5,000 ohm-meter.

According to some embodiments, the outer resistor 164 has an electrical resistance in the range of from about 10 to 2,000 ohms.

According to some embodiments, the outer resistor 164 has a cross-sectional area (in the plane defined by axes B-B and C-C) in the range of from about 0.1 to 3 $mm^2$.

According to some embodiments, the outer resistor 164 has a length L6 (FIG. 11) in the range of from about 3 to 50 mm.

According to some embodiments, the outer resistor 164 has a thickness T6 (FIG. 13) in the range of from about 0.1 to 1 mm.

According to some embodiments, the outer resistor 164 has a width W6 (FIG. 10) in the range of from about 0.2 to 10 mm.

Each contact 170 is U-shaped and includes a body 170A and opposed flanges 170B collectively defining a channel 170C. Each contact 170 is mounted on the trigger device 150 over an end edge 153A, 153B such that the end edge 153A, 153B is received in the channel 170C, the body 170A spans the end face of the substrate 152, and the flanges 170B overlap and engage the inner and outer sides of the substrate 152.

The contacts 170 maybe formed of any suitable material. In some embodiments, the contacts 170 are formed of metal such as nickel sheet.

The bonding agent 128 is bonded to and bonds together the locator members 120 and the substrates 152.

According to some embodiments, the bonding agent 128 is an adhesive. As used herein, adhesive refers to adhesives and glues derived from natural and/or synthetic sources. The adhesive is a polymer that bonds to the surfaces to be bonded. The adhesive 128 may be any suitable adhesive. According to some embodiments, the bonding agent 128 is a glue. Suitable adhesives may include silicate adhesive.

In some embodiments, the adhesive 128 has a high operating temperature, above 800° C.

The gas M may be any suitable gas, and may be a single gas or a mixture of two or more (e.g., 2, 3, 4, 5, or more) gases. According to some embodiments, the gas M includes at least one inert gas. In some embodiments, the gas M includes at least one gas selected from argon, neon, helium, hydrogen, and/or nitrogen. According to some embodiments, the gas M is or includes helium. In some embodiments, the gas M may be air and/or a mixture of gases present in air.

According to some embodiments, the gas M may comprise a single gas in any suitable amount, such as, for example, in any suitable amount in a mixture with at least one other gas. In some embodiments, the gas M may comprise a single gas in an amount of about 0.1%, 0.5%, 1%, 5%, 10%, 15%, 20%, 25%, 30%, 35%, 40%, 45%, 50%, 55%, 60%, 65%, 70%, 75%, 80%, 85%, 90%, 95%, 98%, or 99% by volume of the total volume of gas present in the chamber 108, or any range therein. In some embodiments, the gas M may comprise a single gas in an amount of less than 50% (e.g., less than 40%, 30%, 20%, 10%, 5%, or 1%) by volume of the total volume of gas present in the chamber 108. In some embodiments, the gas M may comprise a single gas in an amount of more than 50% (e.g., more than 60%, 70%, 80%, 90%, or 95%) by volume of the total volume of gas present in the GDT chamber 108. In some embodiments, the gas M may comprise a single gas in an amount in a range of about 0.5% to about 15%, about 1% to about 50%, or about 50% to about 99% by volume of the total volume of gas present in the chamber 108. In some embodiments, the gas M comprises at least one gas present in an amount of at least 50% by volume of the total volume of gas present in the chamber 108. According to some embodiments, the gas M comprises helium in an amount of at least 50% by volume of the total volume of gas present in the chamber 108. According to some embodiments, the gas M comprises at least one gas present in an amount of about 90% or more by volume of the total volume of gas present in the chamber 108, and, in some embodiments, in an amount of about 100% by volume of the total volume of gas present in the chamber 108.

According to some embodiments, the gas M may comprise a mixture of a first gas and a second gas (e.g., an inert gas) different from the first gas with the first gas present in an amount of less than 50% by volume of the total volume of gas present in the chamber 108 and the second gas present in an amount of at least 50% by volume of the total volume of gas present in the chamber 108. In some embodiments, the first gas is present in an amount in a range of about 5% to about 20% by volume of the total volume of gas present in the chamber 108 and the second gas is present in an amount of about 50% to about 90% by volume of the total volume of gas present in the chamber 108. In some embodiments, the first gas is present in an amount of about 10% by volume of the total volume of gas present in the chamber 108 and the second gas is present in an amount of about 90% by volume of the total volume of gas present in the chamber 108. In some embodiments, the second gas is helium, which may be present in the proportions described above for the second gas. In some embodiments, the first gas (which may be present in the proportions described above for the first gas) is selected from the group consisting of argon, neon, hydrogen, and/or nitrogen, and the second gas is helium (which may be present in the proportions described above for the second gas).

In some embodiments, the pressure of the gas M in the chamber 108 of the assembled GDT 100 is in the range of from about 50 to 2,000 mbar at 20 degrees Celsius.

According to some embodiments, the relative dimensions of the insulator 110, the electrodes 140, 142, E1-E21, 144, the trigger devices 150, and the locator members 120 are selected such that the electrodes E1-E21 are loosely captured between the substrate 152 and the insulator bottom wall 112 to permit the electrodes 140, 142, E1-E21, 144 to slide up and down (along axis C-C) a small distance. In some embodiments, the permitted vertical float distance is in the range of from about 0.1 to 0.5 mm. In other embodiments, the substrates 152 fit snuggly against or apply a compressive load to the electrodes E1-E21.

The locator members 120 prevent contact between the inner electrodes E1-E21 and the trigger electrodes 142, 144. According to some embodiments, the minimum width W7 (FIG. 12) of each gap G (i.e., the smallest gap distance between the two electrode surfaces forming the cell C) is in the range of from about 0.2 to 2 mm.

The locator flange 116 prevents contact between the electrodes 140, 142. According to some embodiments, the minimum width W8 (FIG. 4) of the primary GDT gap GP (i.e., the smallest gap distance between the two electrode surfaces forming the cell CP) is in the range of from about 0.3 to 3 mm.

The GDT assembly 100 may be assembled as follows.

The inner electrodes E1-E21 are seated in the slots 124 of the locator members 120 to form a subassembly. The trigger members 150 are installed over the locator members 120 such that the protrusions 126 are received in the recesses 154A. The trigger devices 150 are positioned such that the interface surfaces 161 of the trigger resistors 160 face the edges of the inner electrodes E1-E21 and the top and bottom open sides of the spark gaps G between the inner electrodes E1-E21. More particularly, the interface surfaces 161 are contiguous with the cells C between the inner electrodes E1-E21 and define, in part, the cells C.

The bonding agent 128 (e.g., liquid glue) is then applied at the side joints between the locator members 120 and the trigger devices 150 to bind these components into a subassembly 22.

The subassembly 22 and the trigger end electrodes 142, 144 are inserted into the cavity 112 through the opening 114B. The primary GDT end electrode 140 is inserted into the cavity 112 through the other opening 114A. The bonding layers 119 and seals 118 are heated to bond the terminals 132, 134 to the insulator 134 over the openings 114A, 114B and hermetically seal the openings 114A, 114B. According to some embodiments, the seals 118 are metal solder or brazings, which may be formed of silver-copper alloy, for example.

In some embodiments, the components of the GDT assembly 100 are disposed in an assembly chamber during the steps of sealing the openings 114A, 114B. The assembly chamber is filled with the gas M at a prescribed pressure and temperature. As a result, the gas M is thereafter captured and contained in the chamber 108 of the assembled GDT assembly 100 at a prescribed pressure and temperature. The prescribed pressure and temperature are selected such that the gas M is present at a desired operational pressure when the GDT assembly 100 is installed and in use at a prescribed service temperature.

The trigger resistors 160 are electrically connected on both ends 160A, 160B with trigger end electrodes 142, 144 by the contacts 170. In practice, small gaps may be present between contacts 170 and the trigger end electrodes 142, 144 is allowed. In some embodiments, these gaps are each smaller than 1 mm and, in some embodiments, are in the range of from about 0.1 to 0.3 mm.

In use and operation, the first terminal 132 may be connected to a line or phase voltage of a single or multi-phase power system and the second terminal 134 may be connected to a neutral line of the single or multi-phase power system. The total arcing voltage of the modular, multi-cell GDT assembly 100 generally corresponds to the sum of the arcing voltage of individual series connected single cell GDTs and thus exceeds the peak value of the system voltage. As such, when the modular, multi-cell GDT assembly 100 is in conduction mode, the current flowing therethrough will be generally limited to the current corresponding to a surge event, such as lightning, and not from the system source.

Under normal (i.e., non-conducting) conditions, since no current is flowing through the primary GDT 104, then no current is flowing through the resistors 160, 164 or the multi-cell secondary GDT 102, and the voltage across the GDT assembly 100 is the same as the line-neutral voltage at the second terminal 134.

The operation of the GDT assembly 100 may be loosely regarded as having five steps. When an overvoltage is applied to the system, the overvoltage will be applied to the primary GDT 104. Since the primary GDT 104 is electrically connected to the second terminal 134 by the trigger resistors 160 and/or the outer resistors 164 and the primary GDT 104 is therefore at the same potential as the second terminal 134, the primary GDT 104 reacts to the high voltage and begins to conduct electrical current through the trigger resistors 160 and/or the outer resistors 164. As a result, at the beginning of the surge, a first spark is formed in/across the cell CP of the primary GDT 104 and current passes through the trigger resistors 160 and/or the outer resistors 164. In some embodiments, the resistance of each trigger resistor 160 is chosen such that the specific resistance of each trigger resistor 160 is high enough to be able to conduct (and limit) high current without damage. In some embodiments, the resistance of each trigger resistor 160 is in the range of from about 0.1 to 100 ohms.

As discussed below, the outer resistors 164 may be especially important at the beginning of the surge, when the current is small and is conducted through the outer resistors 164. The provision of the outer resistors 164 provides additional time for the arcs to form between the inner electrodes E1-E21 and through the multi-cell secondary GDT 102 as described herein. When the current through the GDT assembly 100 becomes higher, typically only a relatively small portion of this current will be conducted through the outer resistors 164.

In the second step, during the conducting of the current through the trigger resistors 160, the current generates small sparks along the interface surfaces 161 of the trigger resistors 160. In some embodiments, the material and formation of the resistors 160 is selected to promote this phenomenon, as discussed herein (e.g., using slightly non-homogenous material with some porosity). As discussed and illustrated, the interface surfaces 161 at which sparks are generated is located adjacent, immediately adjacent, and/or contiguous with the cells C. As a result, the sparking on the trigger resistors 160 moves between the resistors 160 and the inner electrodes E1-E21 and into the gaps G and cells C between the inner electrodes E1-E21.

In the third step, this sparking on the trigger resistors 160 in turn promotes, induces or establishes electrical arcing between the facing inner electrodes E1-E21. After a very short time (typically 200 ns or less), stable arcing or sparks are generated or formed between all of the inner electrodes E1-E21 (i.e., across each of the cells C), thereby generating sparks across each of the cells C of the multi-cell secondary GDT 102.

In the fourth step, the secondary impulse current is then conducted through arcs between the inner electrodes E1-E21. The overvoltage is thus applied to the multi-cell secondary GDT 102.

Substantially all of the arcs between the inner electrodes E1-E21 may be formed in the same time period (i.e., rather than strictly sequentially from first inner electrode E1 to last inner electrode E21). The time required to make all of the arcs is shortened by the resistors 160 and the response is quicker. In some embodiments, the arcs are formed between all of the electrodes 142, E1-E21, 144 within a period of less than 0.1 μs and, in some embodiments, less than 1 μs.

In some embodiments, the current may only flow through the trigger resistors 160 until the multi-cell secondary GDT 102 begins to conduct, which may be a very short period of time. For example, current may only flow through the resistors 160 for a time interval that is less than 1 microsecond.

In the fifth step, at the end of the current impulse, the GDT assembly 100 extinguishes the current through the GDT assembly 100. Once the overvoltage condition ceases, the GDTs 102, 104 cease to conduct because the peak value of the system voltage is less than the total arcing voltage of the modular, multi-cell GDT assembly 100.

The extinguishing step may be accomplished even when the terminal electrodes 132, 134 are permanently connected to the network voltage. The extinguishing step is enabled by the provision by the GDT assembly 100 of a sufficiently high total arc voltage, which is made possible by the incorporation of multiple GDTs in the GDT assembly 100. For example, a simple GDT (two electrodes, one arc) may have an arc voltage around 20 V. A multi-cell GDT assembly 100, on the other hand, may have for example, twenty-one inner electrodes (and twenty arcs) with a resulting arc voltage around 400V. If the number of cells is high enough, the follow current through the GDT assembly 100 from network will be practically zero. The short circuit prospective current of the network (i.e., the maximum available current from the network) can be very high (e.g., above 50 kArms). If the arc voltage of the GDT assembly 100 was low, the follow through current through the GDT assembly 100 would be high and would damage the GDT assembly 100. However, with its relatively high arc voltage as discussed above, the GDT assembly 100 will be able to interrupt network currents without damage.

Figure 32:
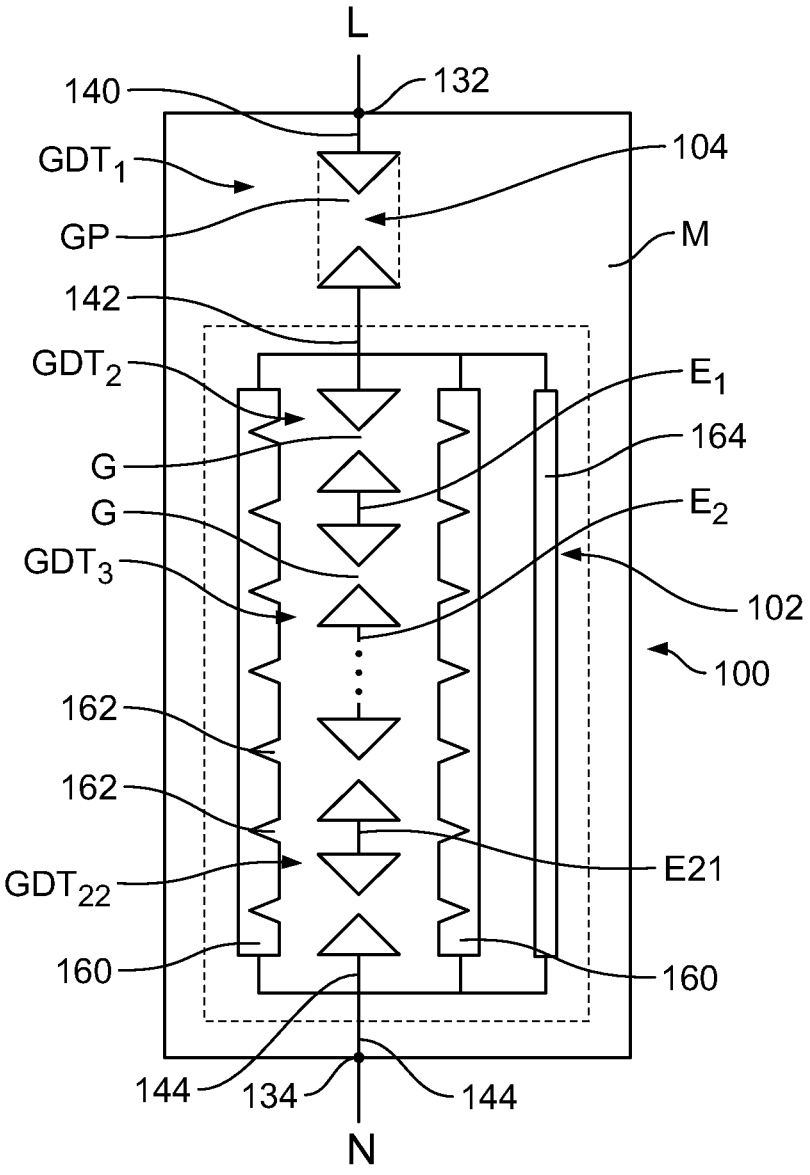
FIG. 32 is an electrical schematic diagram of a circuit formed by the GDT assembly of FIG. 1.

Reference is now made to FIG. 32, which is an electrical schematic circuit of the modular, multi-cell GDT assembly 100. As illustrated, in the electrical schematic context, the modular, multi-cell GDT assembly 100 may function in the same manner as a plurality of single cell GDTs that are arranged serially between terminals 132 and 134. For example, the primary GDT end electrode 140 and the first trigger electrode 142 may function as a first single cell $GDT_1$ (the primary GDT 104); the first trigger electrode 142 and the inner electrode E1 may function as a second single cell $GDT_2$ that is serially connected to the first single cell $GDT_1$; the inner electrode E1 and the inner electrode E2 may function as a third single cell $GDT_3$ that is serially connected to the second single cell $GDT_2$; and so on to the final inner electrode E21 and the trigger end electrode 144, which form a final single cell $GDT_{22}$ in the series.

Each trigger device 150 may include more or fewer inner trigger resistors 160. In some embodiments, the cross-sectional area of each trigger resistor 160 is greater than 0.1 $mm^2$. In some embodiments, the cross-sectional area of each resistor 160 is in the range of from about 0.3 $mm^2$ to 10 $mm^2$. The number of trigger resistors 160 may be as low as one. In some embodiments, each trigger device 150 includes a plurality of resistors 160 and, in some embodiments, at least one trigger resistor 160. The inventors have found that a higher trigger resistor cross-sectional area (for example, 0.5 $mm^2$ or more) and a greater number of trigger resistors 160 (for example, 10 to 20 trigger resistors) provide better response time and better stability in use. In some embodiments, the GDT assembly 100 includes fewer trigger resistors 160 each having greater cross-section areas. In some embodiments, the optimal thickness of each trigger resistor is in the range of from about 0.1 to 1 mm.

The width W8 (FIG. 4) of the gap GP of the primary GDT 104 can be selected to define the prescribed spark-over voltage of the primary GDT 104. The spark-over voltage of the primary GDT 104 is also substantially the same as the prescribed spark-over voltage of the entire GDT assembly 100 because the current through the primary GDT 104 is short-circuited to the other trigger end electrode 144 (and, in turn, to the second terminal electrode 134) through the trigger resistors 160. In some embodiments, small gaps may be permitted or present between some parts of the GDT assembly 100 in order to ease assembly. For example, gaps may be present between the trigger end electrodes 142, 144 and the contacts 170 or between the contacts 170 and the resistors 160. These gaps may increase the spark-over voltage of the overall GDT assembly 100. However, if the gaps are small (e.g., less than 1 mm and, in some embodiments, in the range of from about 0.1 to 0.3 mm), the spark-over voltage of the entire GDT assembly 100 will be only slightly increased over the spark-over voltage of the primary GDT 104 and typically will not significantly affect the intended operation of the GDT assembly 100.

The trigger resistors 160 need to conduct high current and they need to have some resistance (typically in the range of from 0.1 to 100 ohms). If specific resistance is low (e.g., metals), the resistors 160 need to be thin layers and at high current they will be damaged. The current capability is improved if, for a resistor of a given resistance, the cross-sectional area (and mass) of the resistor 160 is increased. Further, the resistor 160 is preferably very immune to high temperature plasma, which is formed between inner electrodes E1-E21 and is in direct contact with resistors 160. As discussed herein, in some embodiments, the resistors 160 are non-homogenous with some porosity to generate sparks on their interface surfaces 161 for ignition of arcs between the inner electrodes E1-E21 (in the cells C). The resistors 160 may be formed of graphite, which can reach proper resistance and cross-sectional area. However, graphite typically will not survive in contact with plasma, and may be damaged by sparks on the interface surfaces 161.

In some embodiments, in order to address the aforementioned objectives and concerns, the resistors 160 are formed of a material including a combination of aluminum and glass. In some embodiments, the aluminum and glass material of the resistors 160 is sintered into the grooves 156 to form the resistors 160. The aluminum and glass material can be sintered at high temperature to form trigger resistors 160 with all of the desired properties. Advantageously, the resistors 160 of this type can be formed to have selected different specific resistances, depending on the design criteria of a given GDT assembly 100 (e.g., by deliberately selecting and using corresponding different weight ratios of aluminum and glass). In some embodiments, the composition of the resistors 160 includes at least 10% by weight of aluminum and at least 10% by weight of glass.

As discussed above, the non-homogeneity and porosity of each trigger resistor 160 (in particular, the interface surface 161 thereof) helps to establish electrical arcs between the inner electrodes E1-E21. Additionally, the narrow crosswise grooves 162 will promote or create arcs between the inner electrodes E1-E21.

In some embodiments, the grooves 162 are formed in the resistors 160 by laser cutting the resistors 160. The depth T4 of laser cut grooves 162 is less than the thickness T3 of the trigger resistor 160 and the groove width W4 (FIG. 9) should be in the range of from about 0.02 to 0.2 mm. In some embodiments, the number of grooves 162 is similar to number of inner electrodes (about 20, for example). Due to the small width W4 of the grooves 162, the final resistance of each resistor 160 is still very similar to the resistance of the initial resistor without cut grooves 162. But the grooves 162 cause formation of small electrical arcs that accelerate and stabilize ignition of arcs between inner electrodes E1-E21.

Another benefit of the grooves 162 is that the grooves 162 also extinguish current through the trigger resistors 160. When current through a resistor 160 is high, only a small part of the current is conducted through the resistor 160 at each groove 162 (i.e., through the remainder portion 163 below the groove 162) because the cross-sectional area of the remainder portion 163 is much smaller than the cross-sectional areas of the resistor 160 between the grooves 162. So the other part of the current is conducted through arcing from one side of each groove 162 to the other side of the groove 162. Practically that means, when current through a resistor 160 is high, the arcs start to limit the current. This may provide two advantages. The trigger resistors 160 are less loaded, and also the current at the end of surge through the resistors 160 is smaller. Less loading means more stable condition of resistors and longer life time. Smaller current after surge means easier extinguishing of follow current from network.

The contacts 170 can help to ensure reliable and consistent operation of the GDT assembly 100. In practice, the sintering process of forming the trigger resistors 160 may not be a very accurate process. For this reason, unwanted gaps can be established between trigger resistors 160 and the trigger end electrodes 142, 144. If the gap is too broad, then additional voltage will be required for ignition of the GDT assembly 100 and, consequently, the protection level provided by the GDT assembly 100 will be diminished. The metal contacts 170 help to ensure good electrical continuity between the resistors 160 and the trigger end electrodes 142, 144 by contacting each and conducting current therebetween. In some embodiments, each contact 170 is formed in the shape of a letter U, the U-shaped contact 170 is placed over an end edge 153A of the substrate 152. The resistor layers 160, 164 are then mounted on the substrate 152 over and in contact with the flanges 170B of the contact 170. In some embodiments, the resistor layers 160, 164 are sintered onto the substrate 152 and the flanges 170B.

The trigger resistors 160 are exposed to very high temperatures of plasma, which is formed during high current surges through the GDT assembly 100. In addition, the trigger resistors 160 need to conduct high current in the initial stage of the surge. The damage to the trigger resistors 160 can cause slower response before first spark formation. For formation of first spark (i.e., the spark across the spark gap GP of the primary GDT 104), the GDT assembly 100 needs a voltage on the first and second terminal electrodes 132, 134 that is at least equal to the spark-over voltage of the primary GDT 104. But if the trigger resistors 160 are damaged, they may not make a sufficient short circuit from the trigger end electrode 142 to the trigger end electrode 144, and the first response can be delayed thereby.

This potential problem is addressed by the additional outer resistor 164 on the back or outer side of each substrate 152. The outer side of the substrate 152 may be regarded as the safe side because it is not exposed to hot plasma and the outer resistor 164 therefore cannot be damaged by plasma. The resistance of each outer resistor 164 can be higher than that of the trigger resistors 160. For example, the resistance of each outer resistor 164 can be in the range of from about 20 to 2000 ohms. Due to this, the currents through the outer resistors 164 are not very high and the outer resistors 164 can survive surges without significant damage. High resistance is allowed for the outer resistors 164 because the outer resistors 164 are needed only at the beginning of surge when total current is low. After a short time period, most of current is then conducted through trigger resistors 160.

In order to fix the inner electrodes E1-E21 in stable positions, it is preferable to use at least two properly shaped rigid insulator members. In the exemplary GDT assembly 100, the inner electrodes E1-E21 are inserted between two ceramic locator members 120 and covered by two ceramic trigger devices or covers 150. After assembling of the parts 120, 150 and E1-E21 together, the resulting subassembly may be very difficult to handle without breaking up. This problem is addressed by the bonding agent (adhesive) 128, which can be safely used in production of the GDT assembly 100. In some embodiments, the glue 128 is a dense liquid of alumina fine powder mixed with potassium or sodium silicate.

In order to perform properly and consistently, the hermetically sealed GDT assembly 100 should not leak gases into or out of the chamber 108. Even if only a small leak of gas occurs due to a crack in the housing insulator 110, the GDT assembly 100 may not be useful any longer. Such cracks may be induced by forces applied to the ceramic housing insulator 110 or high temperature gradients. These forces would be experienced if the inner electrodes E1-E21 were in direct contact with the ceramic housing insulator 110. In this case, the housing insulator 110 would be exposed to hot plasma during high current surges. Also these forces would be experienced if the housing insulator 110 were in contact with the metal inner electrodes E1-E21, which can become very hot. At very high surge currents, some melting of the inner electrodes E1-E21 may be presented. The high temperatures of plasma and the inner electrodes, and also thermal expansion of the inner electrodes E1-E21, could cause cracks in the ceramic housing insulator 110. In addition, during impulses highly ionized plasma is generated in the cells C, which causes high gas pressures, which would press directly on the housing insulator 110.

To address or prevent these problems, the inner electrodes E1-E21 are packed from all lateral sides into the additional reinforcement components 120, 150, each of which include a ceramic body or substrate. The ceramic trigger device substrates 152, with the help of the ceramic locator members 120, protect the ceramic housing insulator 110 against dangerous conditions of high temperatures. In practice, there may typically be a small gap (e.g., less than 1 mm and, in some embodiments, in the range of from about 01 to 0.3 mm) between the ceramic trigger device substrates 152 and the housing insulator 110. With this double wall structure approach, the temperature gradient and pressure forces on the housing insulator 110 are reduced or minimized.

Advantageously, the plurality of spark gaps G, GP are housed or enveloped in the same housing 106 and chamber 108. The plurality of cells C and spark gaps G defined between the electrodes 140, 142, E1-E21, 144 are in fluid communication so that they share the same mass or volume of gas M. By providing multiple electrodes, cells and spark gaps in one common or shared chamber 108, the size and number of parts can be reduced. As a result, the size, cost and reliability of the GDT assembly 100 can be reduced as compared to a plurality of individual GDTs connected in series.

Moreover, the trigger devices 150 are housed or enveloped in the same housing 106 and chamber 108 as the electrodes 140, 142, E1-E21, 144, and are likewise in fluid communication with the same mass of gas M. As a result, the size, cost and reliability of the GDT assembly 100 can be reduced as compared to a plurality of individual GDTs connected in series with an external trigger circuit.

The floating or semi-fixed mounting of the electrodes 140, 142, E1-E21, 144 in the housing 106 can facilitate ease of assembly.

The performance attributes of the GDT assembly 100 can be determined by selection of the gas M, the pressure of the gas M in the chamber 108, the dimensions and geometrics of the electrodes 140, 142, E1-E21, 144, the geometry and dimensions of the housing 106, the sizes of the gaps G, GP, and/or the electrical resistances of the resistors 160, 164.

Figure 17:
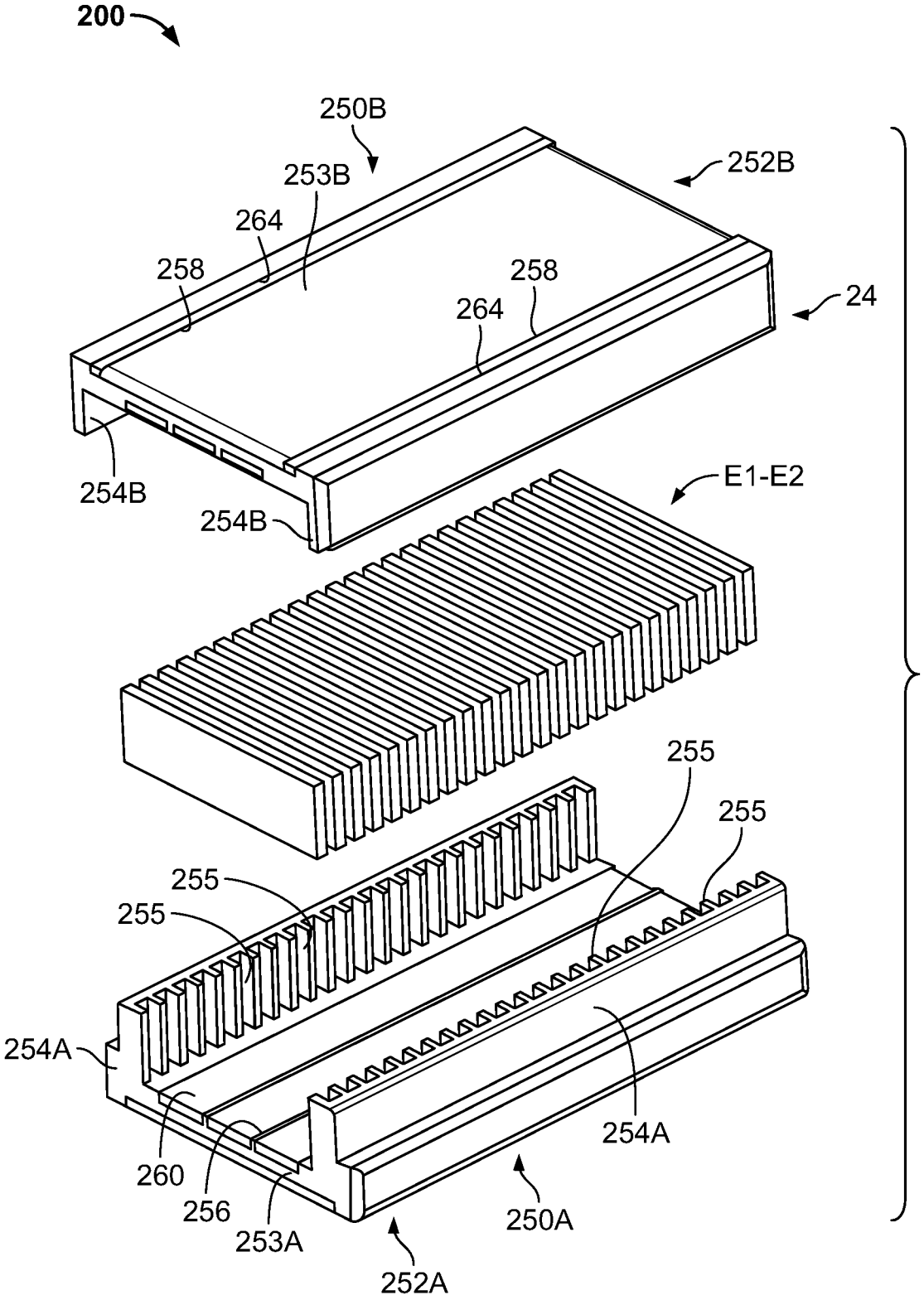
FIG. 17 is an exploded, fragmentary view of a GDT assembly according to further embodiments.

With reference to FIG. 17, a GDT assembly 200 according to further embodiments is shown therein. FIG. 17 shows only a subassembly 24 of the GDT assembly 200 including the inner electrodes E1-E24 and a pair of opposed trigger covers or devices 250A, 250B. The GDT assembly 200 may be constructed and operate in the same manner as the GDT assembly 100 except that, in the GDT assembly 200, the locator members 120 are integrated into the trigger device 250A.

More particularly, the lower trigger device 250A includes a substrate 252A. The substrate 252A includes a body 253A and flanges 254A. Ribs and corresponding locator slots 255 are defined in the inner sides of the flanges 254A. The inner electrodes E1-E24 are seated and retained in the slots 255 in same manner as they are seated in the slots 124 of the GDT assembly 100.

The upper trigger device 250B includes a substrate 252B. The substrate 252A includes a body 253B and flanges 254B. The upper trigger device 250B is mounted on the inner electrodes E1-E24 and the lower trigger device 250A such that the flanges 254B are seated in axially extending channels 254C defined in the lower trigger device 250A.

The substrates 252A, 252B may be formed of the same material(s) as described for the substrate 152. In some embodiments, each substrate 252A, 252B is monolithic.

The trigger devices 250A, 250B also provide a double wall structure (along with the surrounding wall of the insulator housing 110, not shown in FIG. 17) and the corresponding benefits discussed above.

As illustrated in FIG. 17, a GDT assembly as described herein (e.g., the GDT assembly 200) may have fewer, wider inner grooves 256 and inner resistor layers 260. As also illustrated in FIG. 17, a GDT assembly as described herein (e.g., the GDT assembly 200) may have more than one outer groove 258 and more than one outer resistor layer 264.

Figure 18:
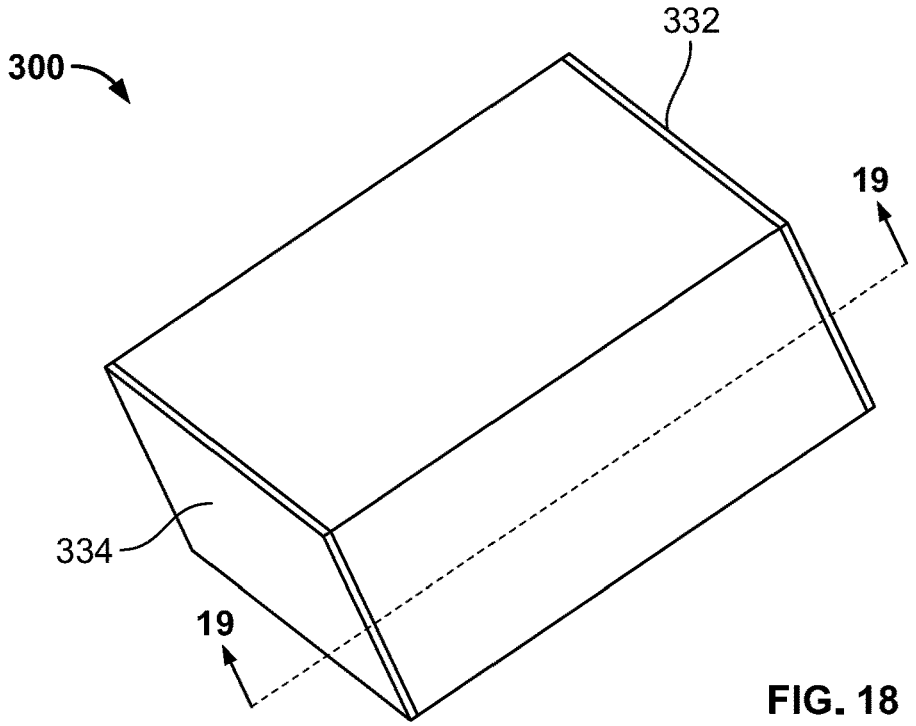
FIG. 18 is a perspective view of a GDT assembly according to further embodiments.
Figure 19:
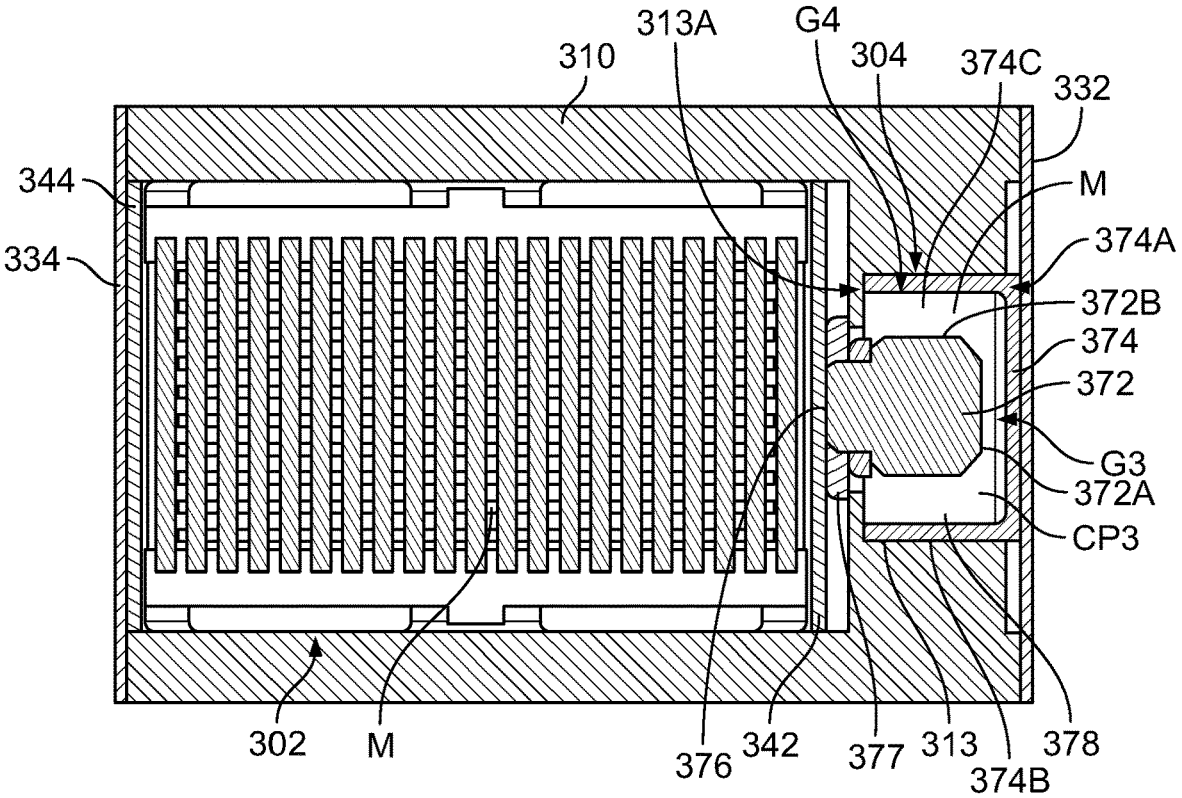
FIG. 19 is a cross-sectional view of the GDT assembly of FIG. 18 taken along the line 19-19 of FIG. 18.
Figure 20:
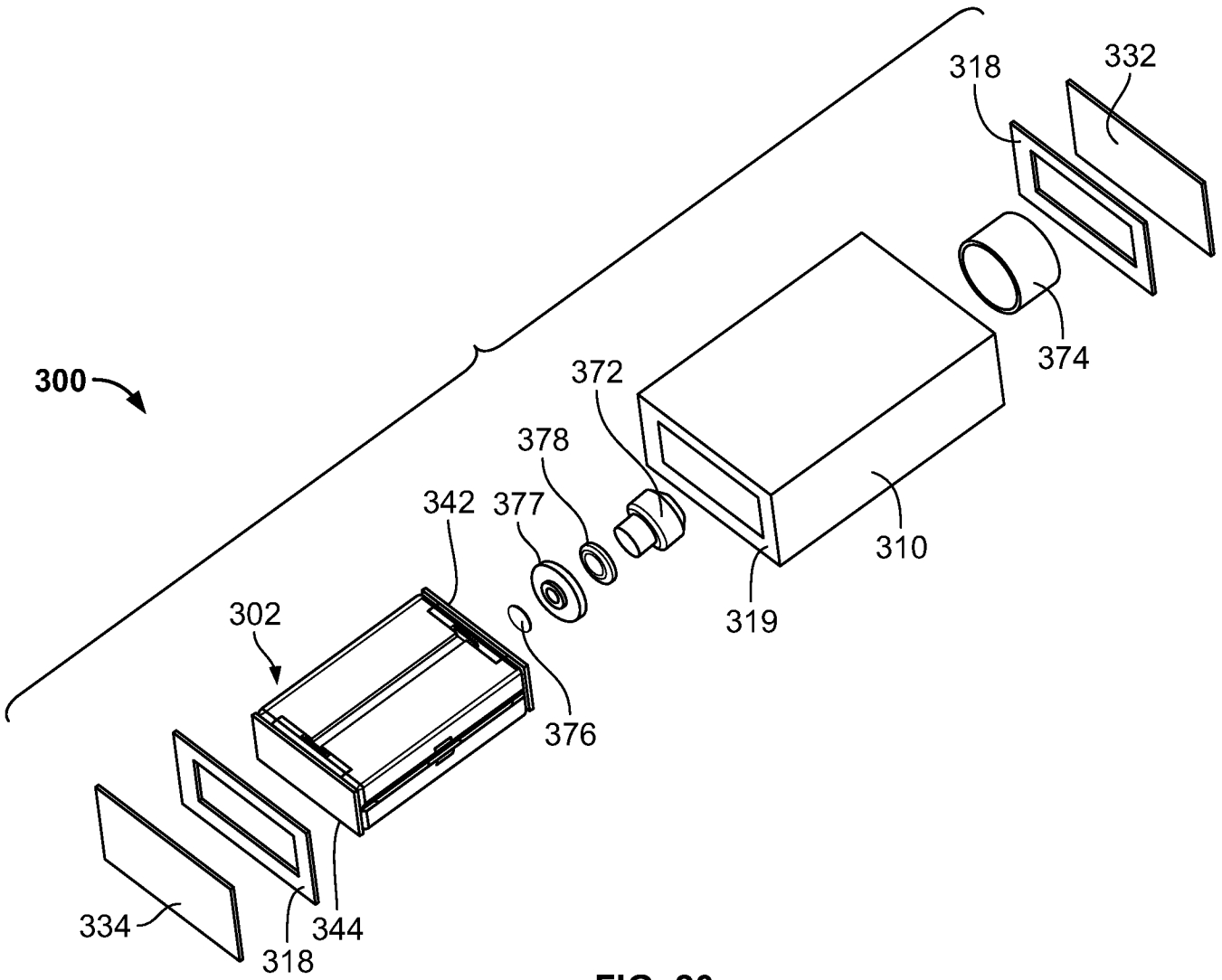
FIG. 20 is an exploded, perspective view of the GDT assembly of FIG. 18.
Figure 21:
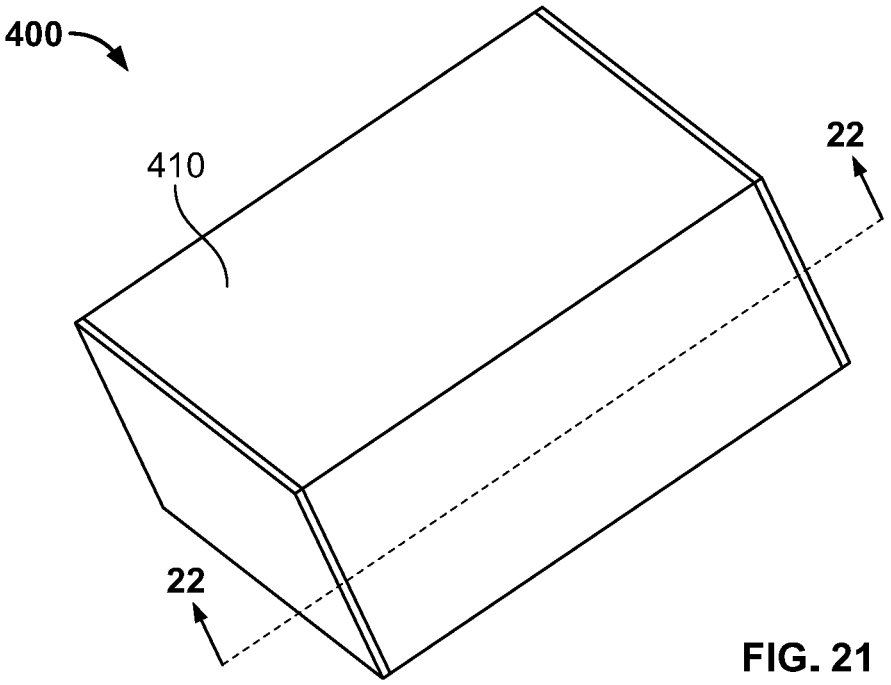
FIG. 21 is a perspective view of a GDT assembly according to further embodiments.
Figure 22:
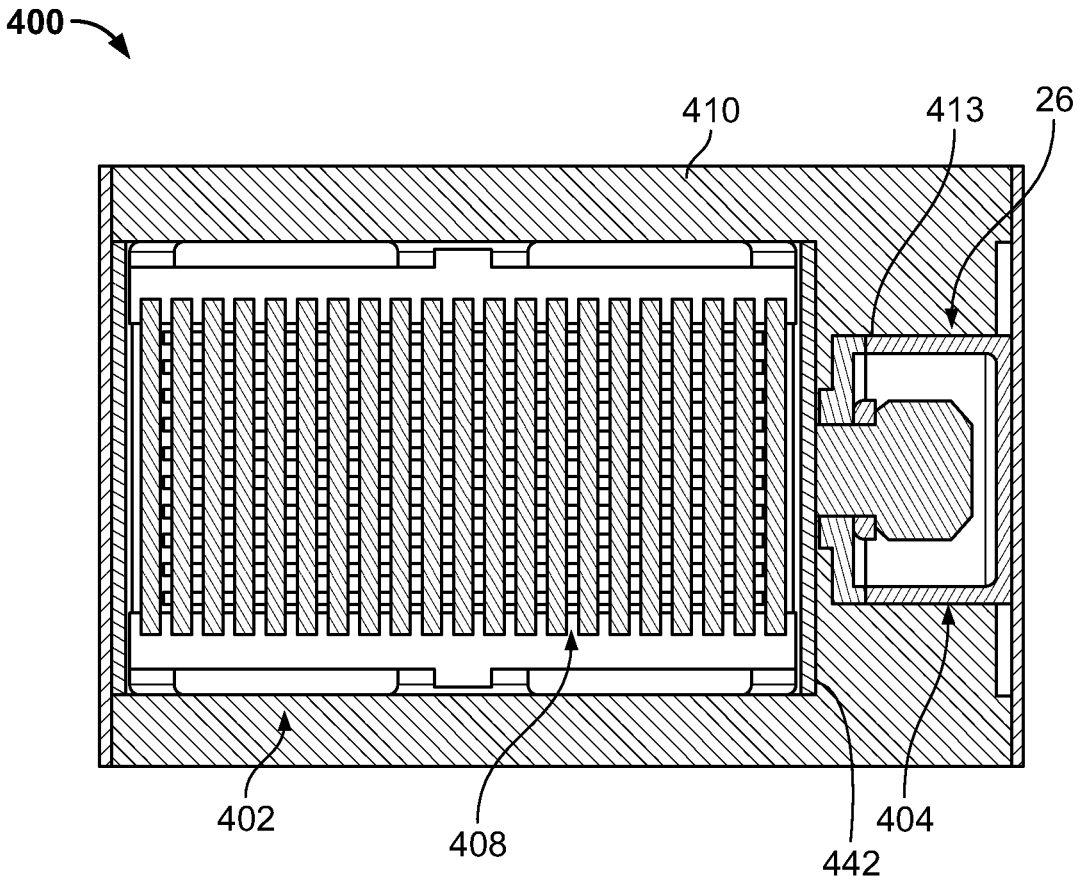
FIG. 22 is a cross-sectional view of the GDT assembly of FIG. 21 taken along the line 22-22 of FIG. 21.
Figure 23:
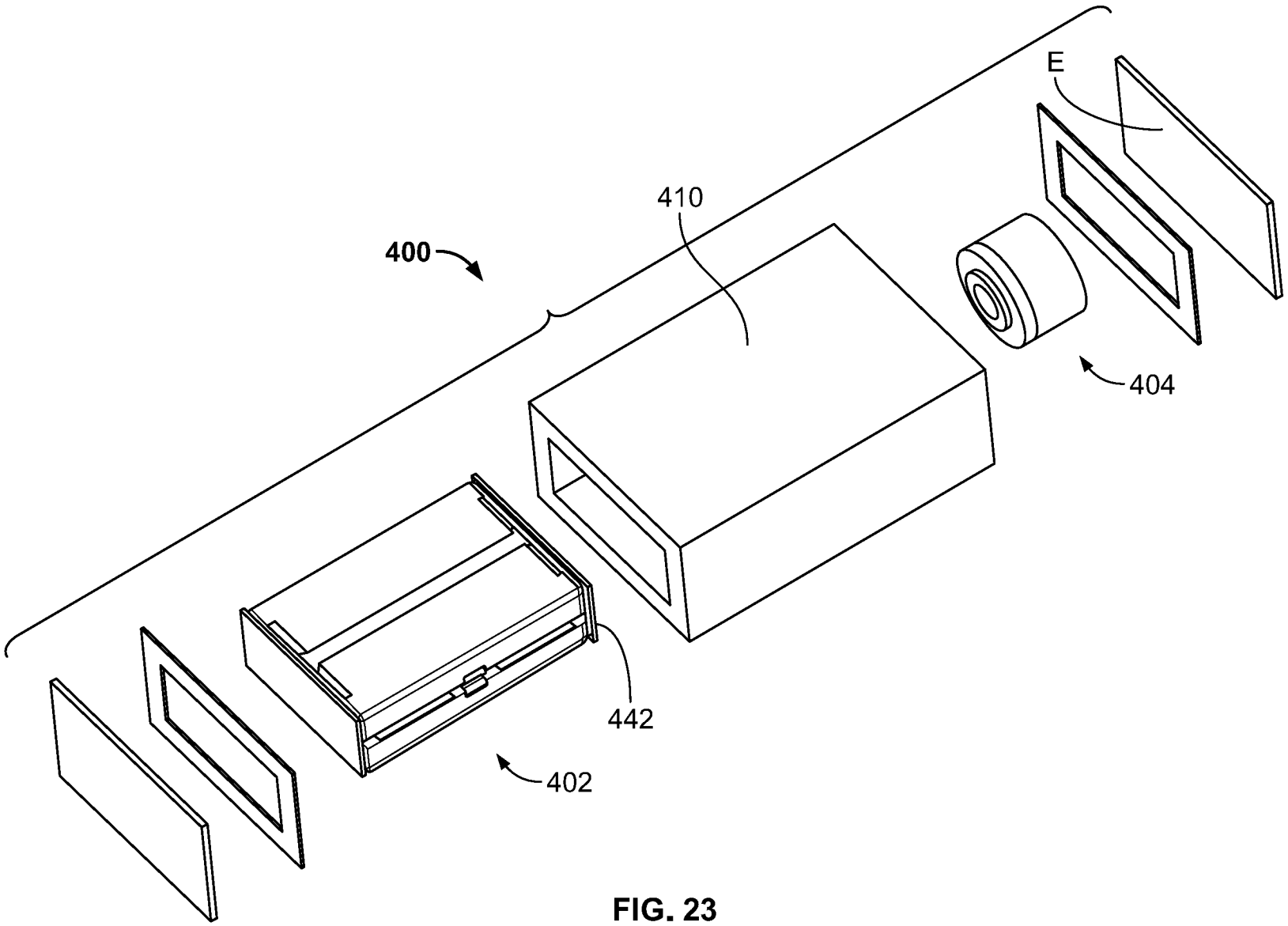
FIG. 23 is an exploded, perspective view of the GDT assembly of FIG. 21.
Figure 24:
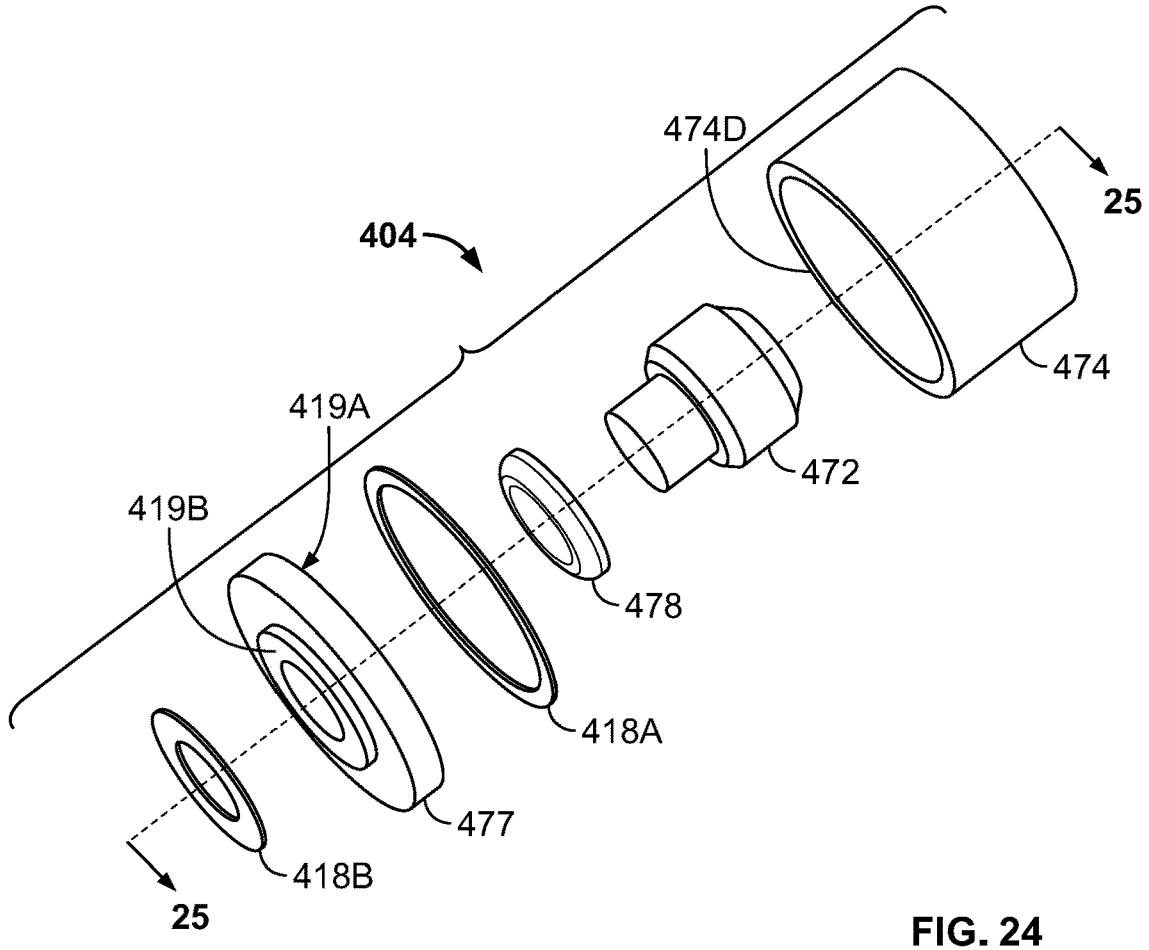
FIG. 24 is an exploded, perspective view of a primary GDT forming a part of the GDT assembly of FIG. 21.
Figure 25:
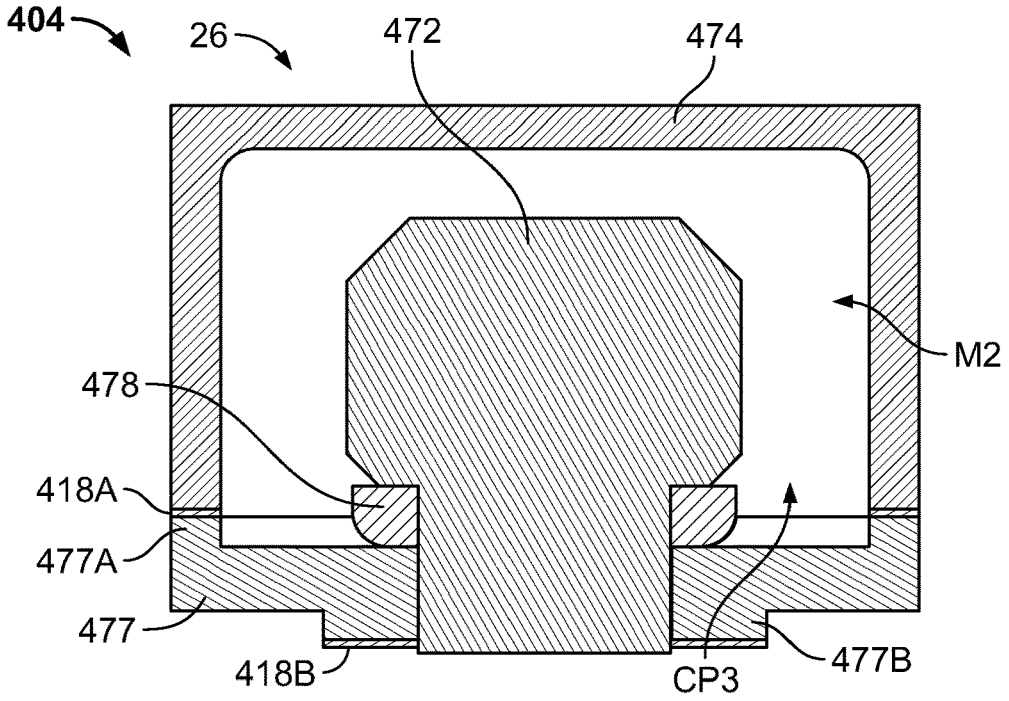
FIG. 25 is a cross-sectional view of the primary GDT of FIG. 24 taken along the line 25-25 of FIG. 24.
Figure 26:
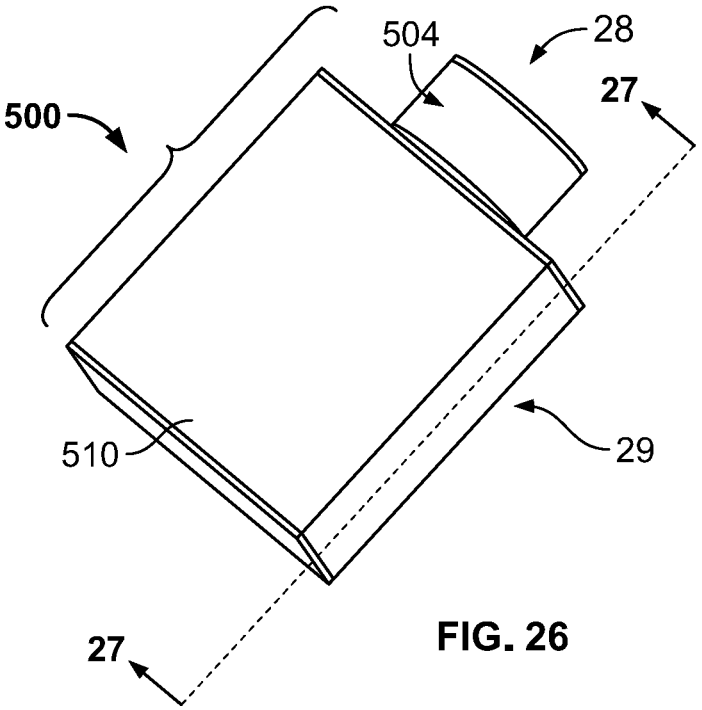
FIG. 26 is a perspective view of a GDT assembly according to further embodiments.

With reference to FIGS. 18-20, a GDT assembly 300 according to further embodiments is shown therein. The GDT assembly 300 may be constructed and operate in the same manner as the GDT assembly 100 except as discussed below. The GDT assembly 300 includes a housing insulator 310, seals 318, bonding layers 319, a first terminal electrode 332, and a second terminal electrode 334 corresponding to the components 110, 118, 119, 132, and 134, respectively, of the GDT assembly 100. The GDT assembly 300 includes a multi-cell secondary GDT 302 corresponding to the multi-cell secondary GDT 102. The secondary GDT 302 has trigger end electrodes 342, 344 corresponding to the electrodes 142, 144.

The GDT assembly 300 includes a primary GDT 304 in place of the primary GDT 104 of the GDT assembly 100. The primary GDT 304 functions generally in the same manner and for the same purpose as the primary GDT 104, but may provide certain advantages in operation.

The primary GDT 304 includes an inner electrode 372, an outer shield electrode 374, a connection medium (e.g., brazing alloy) 376, an annular first insulator member 377, an annular second insulator member 378, and the gas M.

The inner post electrode 372 has the form of a cylindrical post. The post electrode 372 has an outer end surface 372A and a cylindrical side surface 372B. The inner end of the inner electrode 372 is electrically and mechanically connected directly to the trigger end electrode 342 by the brazing alloy 376.

The outer shield electrode 374 has the form of a cylindrical cup defining an inner cavity 374C. The outer shield electrode 374 includes a planar end wall 374A and an annular side wall 374B. The shield electrode 374 is seated in a cavity 313 formed in the end of the housing insulator 310. The shield electrode 374 is axially captured and positioned relative to the post electrode 372 by the first terminal electrode 332 and an integral ledge 313A of the housing insulator 310.

The electrodes 372, 374 are thereby maintained with the post electrode 372 disposed in the cavity 374C. A gap G3 is defined between the end surface 372A and the end wall 374A. A gap G4 is defined between the circumferential surface 372A and the side wall 374B. In this way, a GDT chamber or cell CP3 is formed in the cavity 374C between the electrodes 372, 374. The cell CP3 is filled with the gas M.

The first insulator member 377 is mounted around an inner base of the post electrode 372 between the trigger end electrode 342 and the circumferential surface 372A. The second insulator member 378 mounted around an inner base of the post electrode 372 between the first insulator member 377 and the circumferential surface 372A.

In some embodiments, the insulator members 377, 378 are formed of the same material(s) as described above for the substrates 152.

The electrodes 372, 374 may be formed of any suitable material. According to some embodiments, the electrodes 372, 374 are formed of metal. According to some embodiments, the electrodes 372, 374 are formed of a metal including copper-tungsten alloy. According to some embodiments, the electrodes 372, 374 are formed of a metal including at least 5% by weight of copper-tungsten alloy. According to some embodiments, the electrodes 372, 374 are each unitary and, in some embodiments, monolithic.

In the case of a primary GDT employing two flat electrodes (e.g., the primary GDT 104 including flat electrodes 140 and 142), the flat electrodes work properly at low current impulses. But at high current impulses, such a primary GDT may not extinguish as needed. The cylindrically shaped primary GDT 304 addresses this problem by providing more stable operation and improve extinguishing of follow current.

The first insulator member 377 prevents sparking directly between the shield electrode 374 and the trigger end electrode 342. The second insulator member 378 prevents formation of a conductive layer of evaporated electrode material between the post electrode 372 and the shield electrode 374.

With reference to FIGS. 21-25, a GDT assembly 400 according to further embodiments is shown therein. The GDT assembly 400 may be constructed and operate in the same manner as the GDT assembly 300 except as discussed below. The GDT assembly 400 includes a multi-cell secondary GDT 402 corresponding to the multi-cell secondary GDT 102 and the multi-cell secondary GDT 302.

The GDT assembly 400 includes a primary GDT 404 in place of the primary GDT 304 of the GDT assembly 300. The primary GDT 404 functions in the same manner and for the same purpose as the primary GDT 304, but can be more easily preassembled for assembly with the multi-cell secondary GDT 402 and the housing insulator 410 to form the GDT assembly 400.

The primary GDT 404 includes an inner electrode 472, an outer shield electrode 474, a first bonding layer 419A (e.g., metallization), a second bonding layer 419B (e.g., metallization), a first connection medium 418A (e.g., brazing alloy), a second connection medium 418B (e.g., brazing alloy), an annular first insulator member 477, an annular second insulator member 478, and a gas M2.

The components 472, 474, and 478 may be constructed in the same manner as the components 372, 374, and 378 of the primary GDT 304. The bonding layers 419A, 419B may be formed of the same materials as described for the bonding layers 119. The connection mediums 418A, 418B may be formed of the same materials as described for the seals 118.

The insulator member 477 corresponds to the insulator member 377 except that the insulator member 477 includes a base 477B and an integral extended annular flange 477A. The bonding layers 419A, 419B are disposed on the end faces of the flange 477A and the base 477B.

The end face of the flange 477A is bonded to the inner end face 474D of the side wall of the shield electrode 474 by the bonding layer 419A and the connection medium 418A. The insulator member 478 is captured between the insulator member 477 and an enlarged head of the post electrode 472. The inner end of the post electrode 472 is bonded to the insulator member 477 by the bonding layer 419B and the connection medium 418B. The bonding layer 419B forms a seal between the insulator member 477 and the side perimeter of an endmost section of the post electrode 472. The connection medium 418B is melted to make a seal between the components 419B, 472. The inner end face 472C of the post electrode 472 is held in close contact with the trigger end electrode 442. A chamber or cell CP3 is defined within the shield electrode 474 and the insulator member 477. The cell CP3 is filled with the gas M2.

Figure 29:
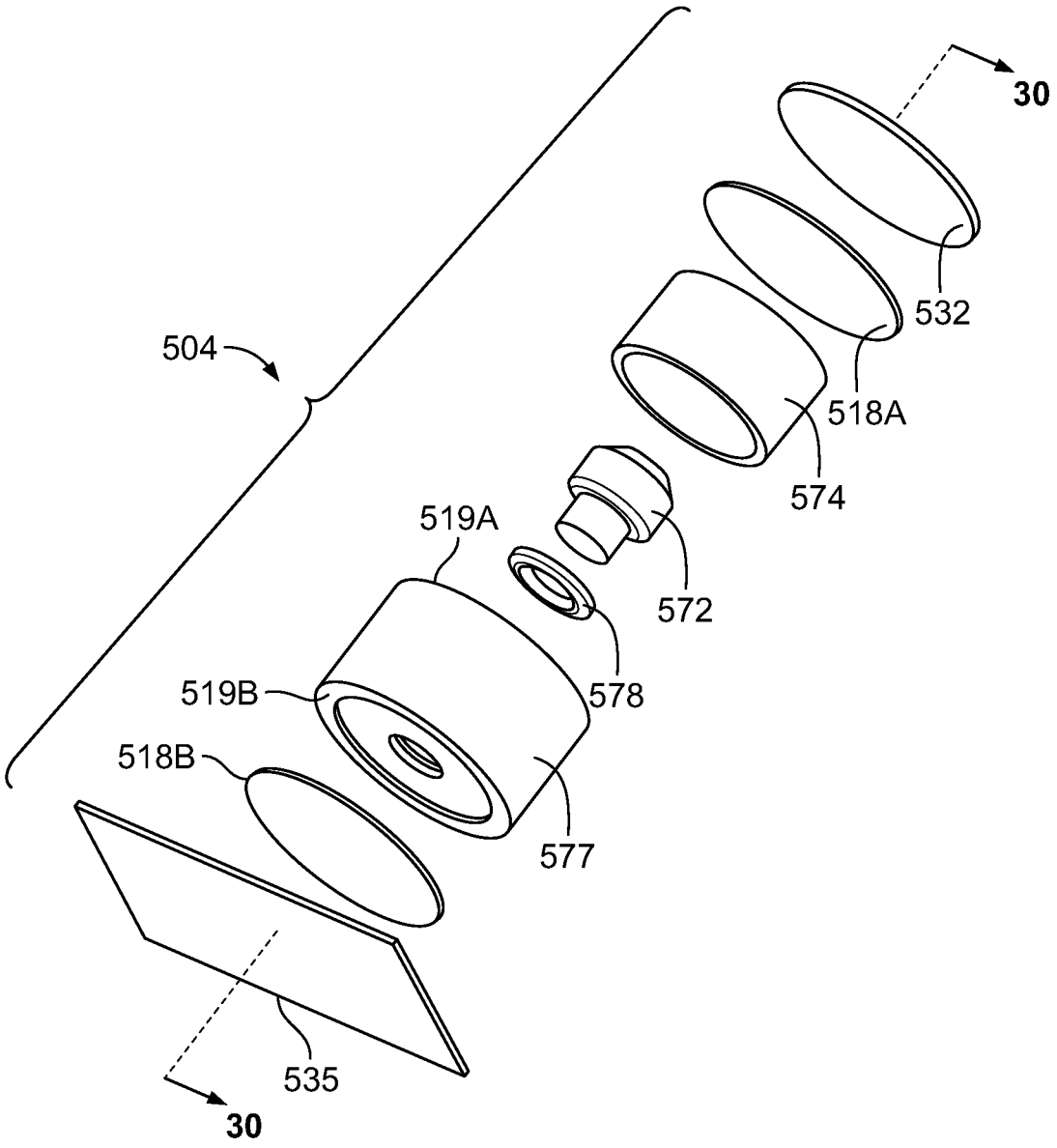
FIG. 29 is an exploded, perspective view of a primary GDT forming a part of the GDT assembly of FIG. 26.

In some embodiments, the flange 477A is bonded to the shield electrode 474 as described, with the insulator member 478 and the post electrode 472 captured therein, to form a module or subassembly 26 as shown in FIG. 29. The preassembled subassembly 26 is then inserted into a cavity 413 of the housing insulator 410 and the electrode 472 makes contact with the trigger end electrode 442. A small gap (e.g., less than 1 mm, and in some embodiments, in the range of from about 0.1 to 0.3 mm) may be present between the post electrode 472 and the trigger end electrode 442.

In some embodiments, the subassembly 26 is provided with a small gap or hole to allow gases to leak into and out from the cell CP3. In some embodiments, the cell CP3 is filled through the hole or gap with the same gas M as the chamber 408 of the multi-cell secondary GDT 402 (i.e., the gas M2 is the gas M).

In some embodiments, the subassembly 26 is formed such that the chamber or cell CP3 is hermetically sealed. In this case, the connection layers 418A, 418B (e.g., brazing alloys) may be selected to have higher melting points than the seals 418 (e.g., brazing alloys). The chamber CP3 is thus sealed from the multi-cell GDT chamber 408. The chamber CP3 is filled with a different gas mixture M2 than the gas mixture M used in the chamber 408 of the multi-cell secondary GDT 402. The benefit of this is that the manufacturer can use special gases for gas M with relatively higher arc voltage in the multi-cell secondary GDT 402 to ensure better extinguishing, while using different gas M2 in the primary GDT 402 to optimize the spark-over voltage of primary GDT 402.

With reference to FIGS. 26-30, a GDT assembly 500 according to further embodiments of the invention is shown therein. The GDT assembly 500 may be constructed and operate in the same manner as the GDT assembly 400 except as discussed below. The GDT assembly 500 includes a multi-cell secondary GDT 502 corresponding to the multi-cell secondary GDT 102 and the multi-cell secondary GDT 402.

The GDT assembly 500 includes a primary GDT 504 in place of the primary GDT 404 of the GDT assembly 400. The primary GDT 504 functions in the same manner and for the same purpose as the primary GDT 404. The primary GDT 504 can be preassembled for assembly with the multi-cell secondary GDT 502 and the housing insulator 510 to form the GDT assembly 500. The GDT assembly 500 includes a bonding layer 519C and a connection medium 518C that seals the primary GDT 504 to the housing insulator 570.

The primary GDT 504 includes a terminal electrode 532, a base electrode 535, an inner electrode 572, an outer shield electrode 574, a first bonding layer 519A (e.g., metallization), a second bonding layer 519B (e.g., metallization), a first connection medium 518A (e.g., brazing alloy), a second connection medium 518B (e.g., brazing alloy), an annular first insulator member 577, an annular second insulator member 578, and a gas M3.

The components 572, 574, and 578 may be constructed in the same manner as the components 472, 474, and 478 of the primary GDT 404. The bonding layers 519A, 519B may be formed of the same materials as described for the bonding layers 119. The connection mediums 418A, 518B may be formed of the same materials as described for the seals 119.

The insulator member 577 corresponds to the insulator member 477 except that the integral extended annular flange 577A of the insulator member 577 circumferentially surrounds the shield electrode 574 and extends axially to the outer end of the shield electrode 574. The bonding layers 519A, 519B are disposed on the end faces of the flange 577A and the base 577B.

The end face of the flange 577A is bonded to an inner end face of the terminal electrode 532 by the bonding layer 519A and the connection medium 518A. The insulator member 578 is captured between the insulator member 577 and an enlarged head of the post electrode 572. The end face of the base 577B is bonded to the base electrode 535 by the bonding layer 519B and the connection medium 518B. The inner end face 572C of the post electrode 572 is directly secured and electrically connected to the base electrode 535 by the bonding layer 519B and the connection medium 518B. When the GDT assembly 500 is assembled, the base electrode 535 is in electrical contact with the trigger end electrode 542.

A chamber or cell CP4 is defined within the shield electrode 574 and the insulator member 577. The cell CP4 is filled with the gas M3.

Figure 30:
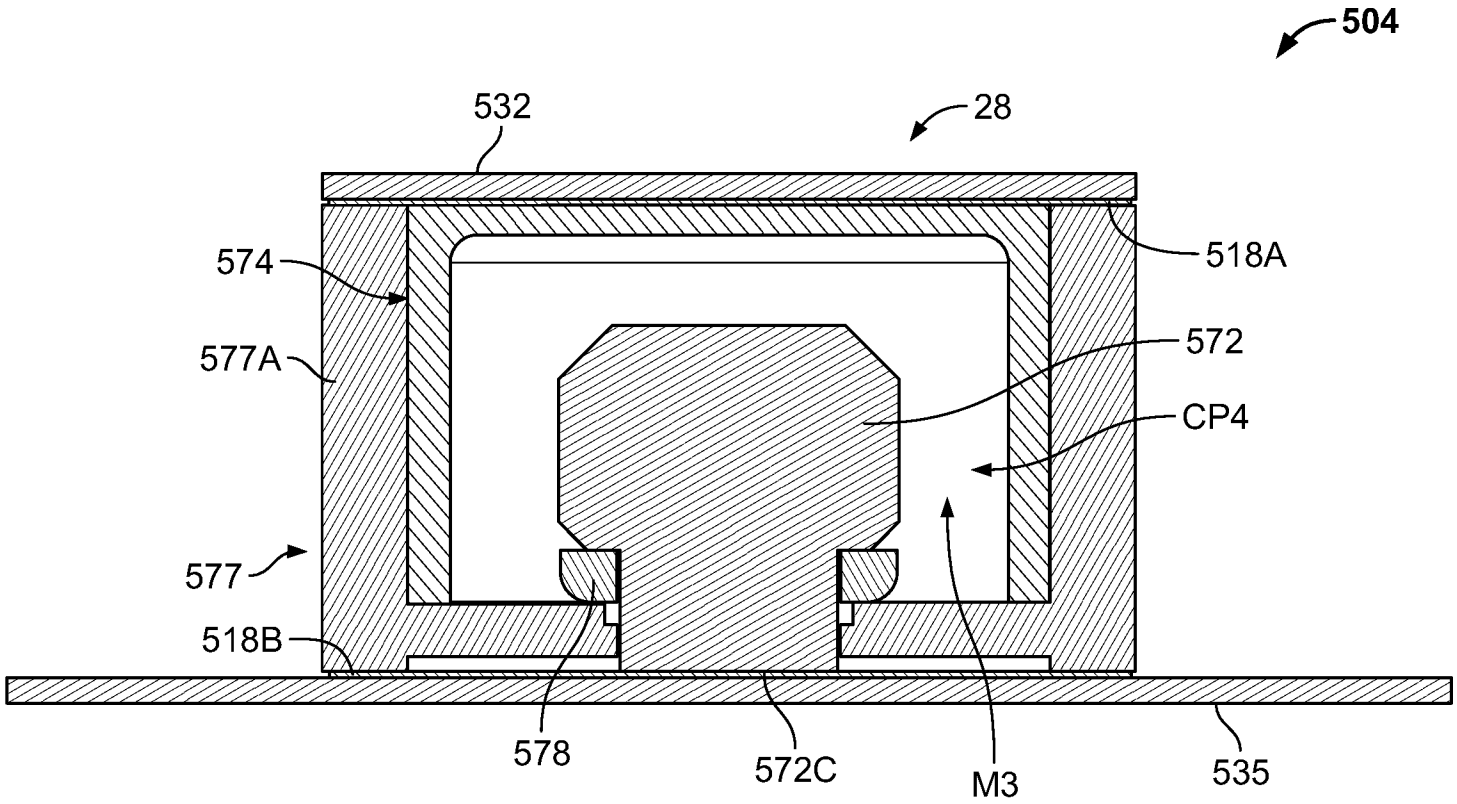
FIG. 30 is a cross-sectional view of the primary GDT of FIG. 29 taken along the line 30-30 of FIG. 29.

In some embodiments, the flange 577A is bonded to the terminal electrode 532 as described, with the insulator member 578 and the post electrode 572 captured therein, and base electrode 535 is bonded to the insulator member 577, to form a module or subassembly 28 as shown in FIG. 30. The preassembled subassembly 28 is then bonded to the housing insulator 510 by bonding the base electrode 535 to the housing insulator 510. Alternatively, the base electrode 535 can be bonded to the insulator 577 after the base electrode 535 has been bonded to the insulator 510. The housing 510 and the remainder of the multi-cell secondary GDT 502 may be preassembled to form a secondary GDT subassembly 29. The primary GDT subassembly 28 may thereafter be mounted on the secondary GDT subassembly 29 as described above (i.e., by first bonding the base electrode 535 to the insulator member 577, or by first bonding the base electrode to the housing 510). A seal 518D (e.g., brazing alloy) between the base electrode 535 and the housing 510 hermetically seals the housing chamber 508.

In some embodiments, the subassembly 28 is formed such that the chamber or cell CP4 is hermetically sealed. In some embodiments, the cell CP4 is filled with the same gas M3 as the multi-cell GDT 502. For example, the primary GDT 504 may be assembled in same gas-filled manufacturing chamber as all other components so that the same gas is captured in both the chamber CP4 and the housing chamber 508.

In some embodiments, the chamber CP4 is filled with a different gas mixture M3 than the gas mixture M used in multi-cell secondary GDT 502, and the gases M, M3 may be selected to provide benefits as discussed above with regard to the GDT assembly 400.

Accordingly, the GDT assembly 500 incorporates two different chambers (i.e., chamber CP4 for the primary GDT 504, and chamber 508 for the multi-cell secondary GDT 502). The primary GDT 504 can be preassembled and easily soldered or brazed on the base electrode 535.

Compared to the GDT assemblies 300, 400, the GDT assembly 500 may allow much faster temperature increase if the GDT assembly 500 fails. That is, the primary GDT 502 will heat faster than the primary GDT 302, for example. In this case, the GDT assembly 300, 400, 500 will normally go to short circuit. The temperature will increase faster on the outer surface of the externally mounted primary GDT 502 than on the outer surface of the housing of the overall GDT assembly 300, 400, 500. This effect can be used to more quickly signal that the GDT assembly has failed or to more quickly actuate a disconnect mechanism that disconnects the GDT assembly from network.

Figure 27:
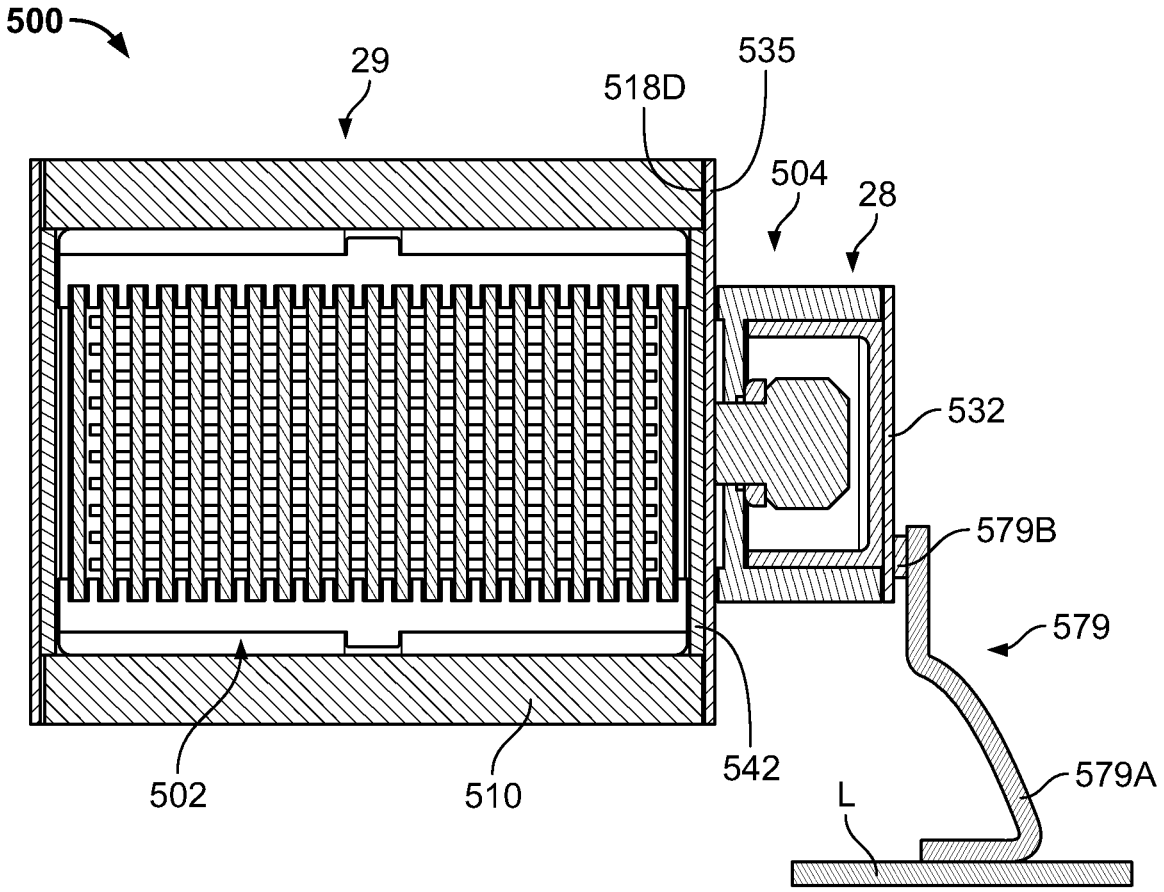
FIG. 27 is a cross-sectional view of the GDT assembly of FIG. 26 taken along the line 27-27 of FIG. 26.
Figure 28:
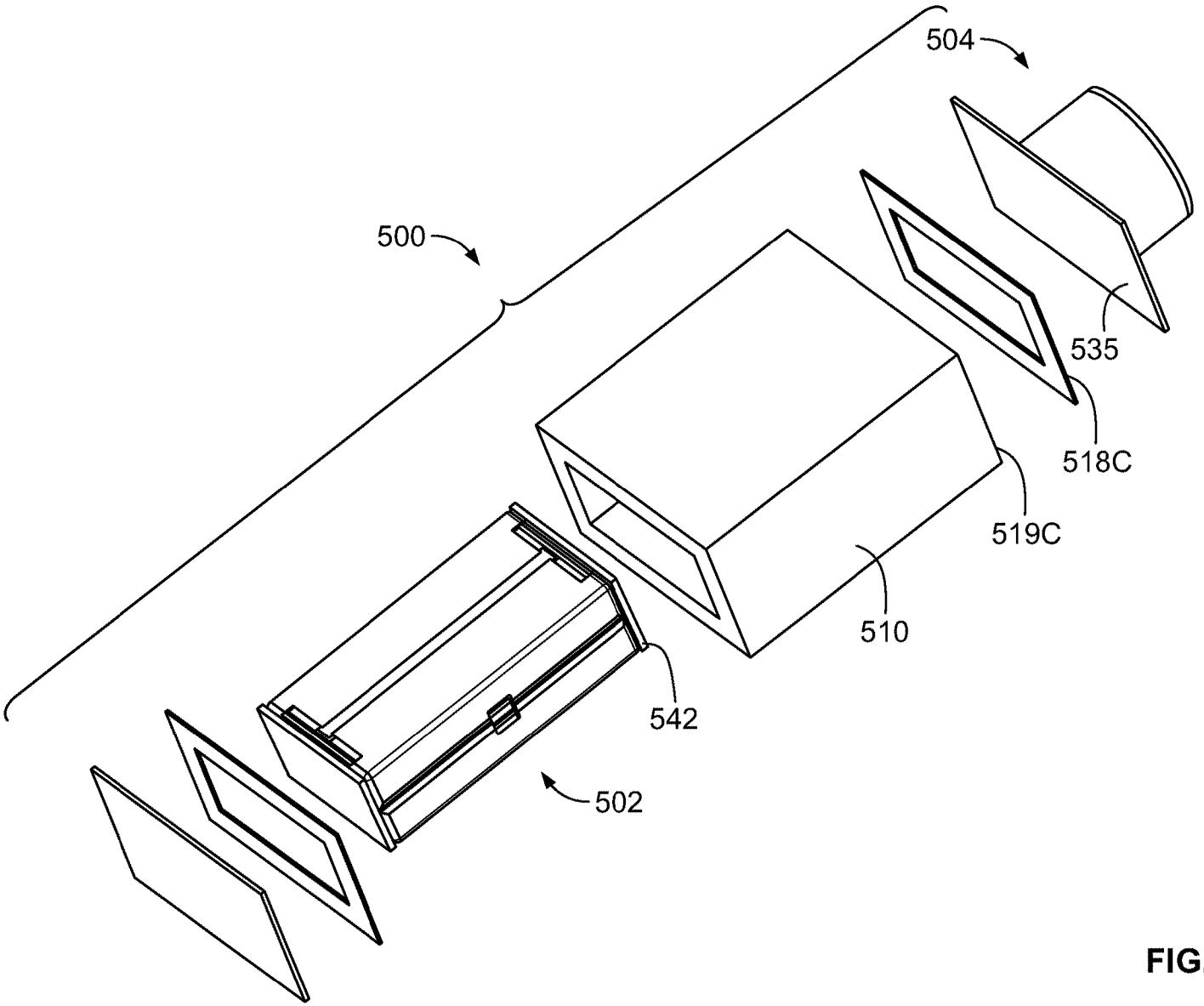
FIG. 28 is an exploded, perspective view of the GDT assembly of FIG. 26.

For example, as shown in FIG. 27, the GDT assembly 500 can be connected to a line L of the network by a disconnect mechanism 579. In some embodiments, the disconnect mechanism 579 is a thermal disconnect mechanism that responds to the heat generated in the GDT assembly 500 to disconnect the GDT assembly 500 from a circuit. In the illustrated embodiment, the disconnect mechanism 579 includes a spring contact 579A and meltable solder 579B securing an end of the spring contact to the terminal electrode 532. When the GDT assembly 500 fails (e.g., the multi-cell secondary GDT 502 short-circuits internally), the primary GDT 504 will quickly heat up until the solder 579B melts sufficiently to release the spring contact 579A (which is biased or loaded away from the terminal electrode 532). The GDT assembly 500 is thereby disconnected from the line L.

Figure 31:
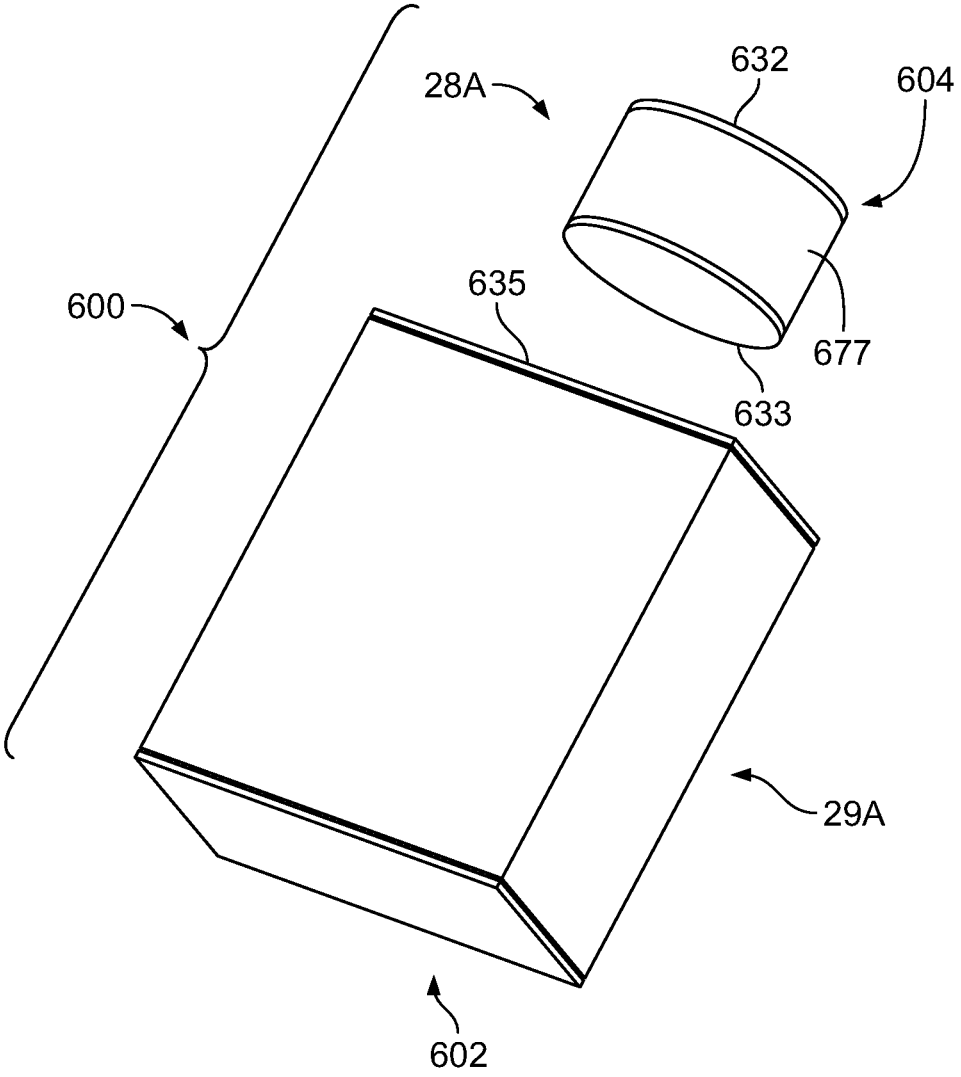
FIG. 31 is an exploded, perspective view of a GDT assembly according to further embodiments.

FIG. 31 shows a GDT assembly 600 according to further embodiments in exploded view. The GDT assembly 600 is constructed and operates in the same manner as the GDT assembly 500, except as follows.

The GDT assembly 600 includes a multi-cell secondary GDT 602 and a primary GDT 604.

The multi-cell secondary GDT 602 is of the same construction and operation as the multi-cell secondary GDT 502. The secondary GDT 602 is embodied in a subassembly 29A that includes an outer electrode 635 corresponding to the base electrode 535.

The primary GDT 604 is embodied in a preassembled module or subassembly 28A in place of the subassembly 28. The primary GDT 604 may be of the same construction and operation as the primary GDT 504, except that the primary GDT 604 includes a base electrode 633 in place of the base electrode 535. The primary GDT 604 is mechanically and electrically connected to the secondary GDT by bonding (e.g., soldering) the base electrode 633 to the outer electrode 635. The base electrode 633 of the subassembly 28A conforms to the shape of the insulator member 677 and the terminal electrode 632. Other shapes for the electrodes 633, 632 may be used.

Figure 33:
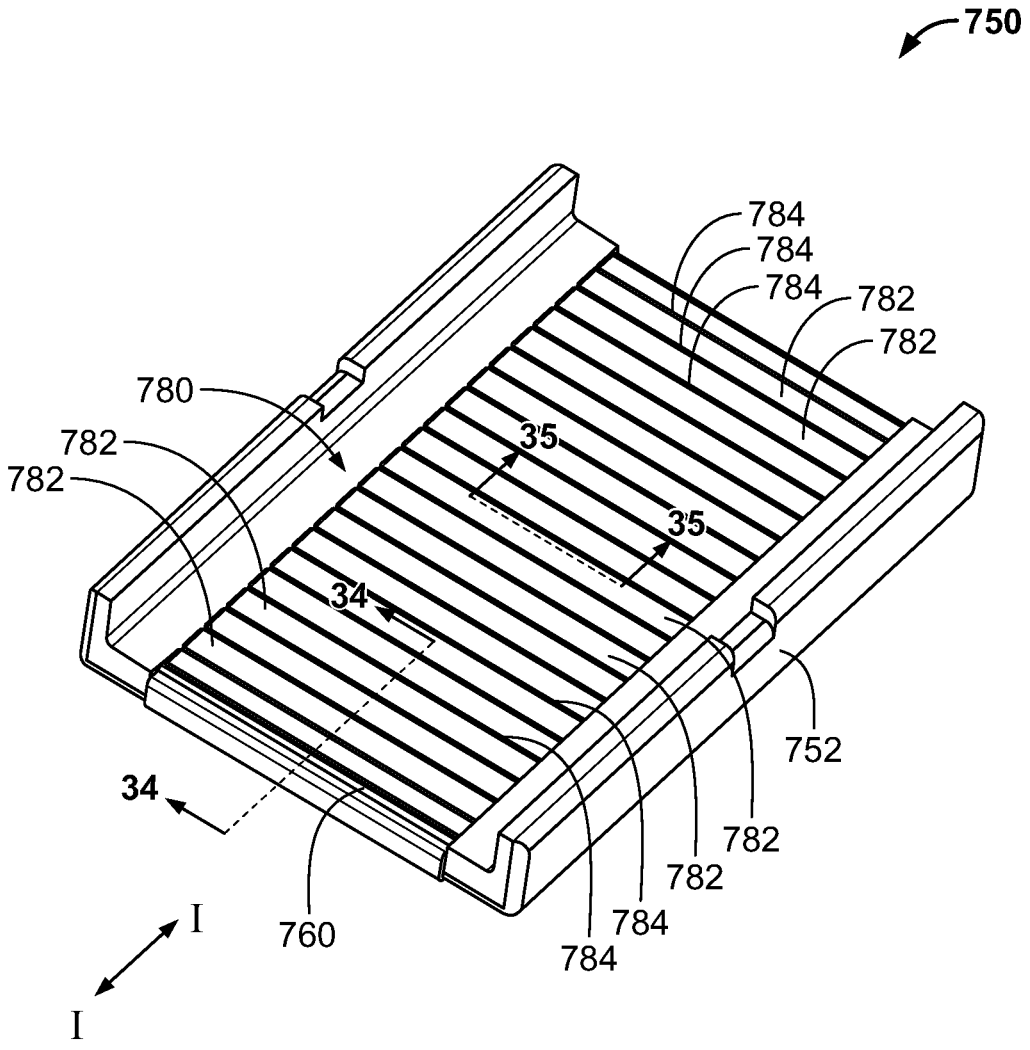
FIG. 33 is a perspective view of a trigger device according to further embodiments.

With reference to FIG. 33, a trigger device 750 according to further embodiments is shown therein. The trigger device 750 may be constructed and operate in the same manner as the trigger device 150 except as discussed below.

The trigger device 750 includes a substrate 752 and a plurality of inner trigger resistor layers or resistors 760 corresponding to the substrate 152 and the resistors 160.

The trigger device 750 further includes a plurality or set 780 of resistor protection layers 782 covering the inner sides of the resistors 760. The resistor protection layers 782 collectively form an electrically insulating layer covering major surfaces of the resistors 760 that would otherwise be exposed to the GDT chamber 108 and the gas M contained therein.

In some embodiments, each resistor protection layer 782 is disposed in direct contact with one or more of the inner surfaces 761 of the resistors 760. In some embodiments, each resistor protection layer 782 is bonded to one or more of the inner surfaces 761 of the resistors 760.

In some embodiments, each resistor protection layer 782 is an elongate layer or strip that extends transversely across the trigger device 750 and covers portions of a plurality of the resistors 760. In some embodiments, each resistor protection layer 782 extends transversely (relative to the longitudinal axis I-I) across the trigger device 750 and covers portions of all of the resistors 760.

The layer 780 includes a plurality of axially spaced apart and serially distributed channels or gaps 784 defined between the adjacent edges of the resistors 760. The gaps 784 extend lengthwise transverse to the axis I-I. Each gap 784 is aligned with a respective one of the resistor grooves 762 so that the groove 762 is exposed through the gap 784.

In use, the resistors 160 of the GDT assembly 100, for example, may be exposed to hot plasma. In some cases (e.g., strong current impulses), the plasma can damage the resistors 160 and change the electrical conductivity of the resistors 160. In operation, the resistor protection layers 782 serve to protect the resistors 760 from the plasma.

The gaps 784 enable the surfaces of the resistors 760 exposed within the grooves 762 to contact the gas within the chamber of the gas discharge tube assembly. This can enable the gas discharge tube assembly to achieve a short response time in the case of an overvoltage.

Figure 34:
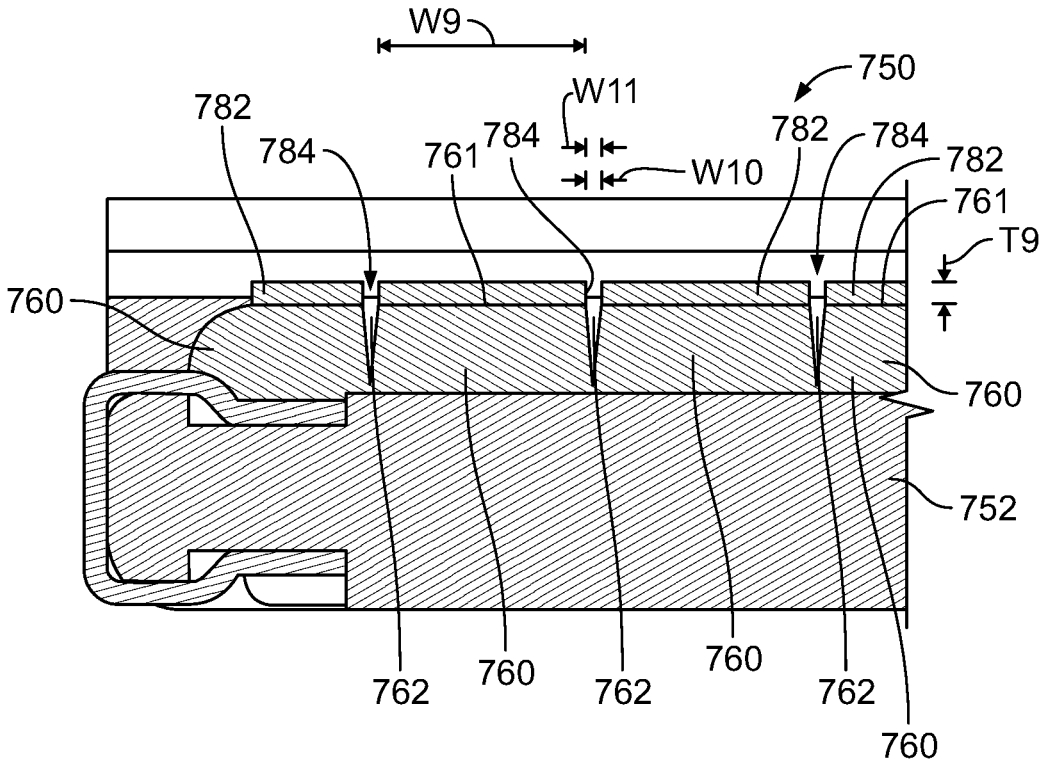
FIG. 34 is a cross-sectional view of the trigger device of FIG. 33 taken along the line 34-34 of FIG. 33.

In some embodiments, each resistor protection layer 782 has a thickness T9 (FIG. 34) of at least about 0.01 mm, in some embodiments, in the range of from about 0.01 mm to 0.5 mm, and, in some embodiments, in the range of from about 0.08 mm to 0.12 mm.

In some embodiments, each resistor protection layer 782 has a width W9 (FIG. 34) of at least about 1 mm and, in some embodiments, in the range of from about 0.3 to 7 mm.

In some embodiments, the width W11 (FIG. 34) of each gap 784 is substantially the same as the width W10 (FIG. 34) of the adjacent groove 762.

The protection layers 782 are formed of an electrical insulator (i.e., a substantially electrically nonconductive or insulating material). The protection layers 782 are formed of a material having a lower electrical conductivity value than the electrical conductivity of the resistors 760. In some embodiments, the electrical conductivity of the material of the resistors 760 is at least 10 times the electrically conductivity of the protection layers 782.

In some embodiments, the protection layers 782 include potassium or sodium silicate. In some embodiments, the protection layers 782 include alumina fine powder. The alumina may improve stability because alumina powder is very stable at high temperatures (e.g., temperatures caused by plasma).

The protection layers 782 may be mounted on the resistors 760 using any suitable technique. In some embodiments, the protection layers 782 are deposited on the resistors 760. In some embodiments, an enlarged layer (e.g., a single layer) of the electrically nonconductive material is mounted on the resistors 760, and the gaps or channels 784 are then cut into the nonconductive layer. In some embodiments, the gaps or channels 784 are laser cut into the nonconductive layer.

With reference to FIGS. 36-42, a surge protective device (SPD) module 40 according to embodiments of the invention is shown therein. The SPD module 40 includes a GDT assembly 800 according to further embodiments of the invention is shown therein. However, it will be appreciated that the SPD module 40 may include a GDT assembly according to other embodiments (e.g., the GDT assembly 500 or 600) in place of the GDT assembly 800. It will also be appreciated that the GDT assembly 800 may be used in other applications (e.g., not in an SPD module).

The GDT assembly 800 is constructed and operates in the same manner as the GDT assembly 600, except as discussed below. The GDT assembly 800 includes a multi-cell secondary GDT 802 (corresponding to the secondary GDT 602) and a primary GDT 804.

The multi-cell secondary GDT 802 is of the same construction and operation as the multi-cell secondary GDT 602. The secondary GDT 802 is embodied in a subassembly 29B that includes an outer electrode 835 corresponding to the outer electrode 635 and the base electrode 535.

Figure 35:
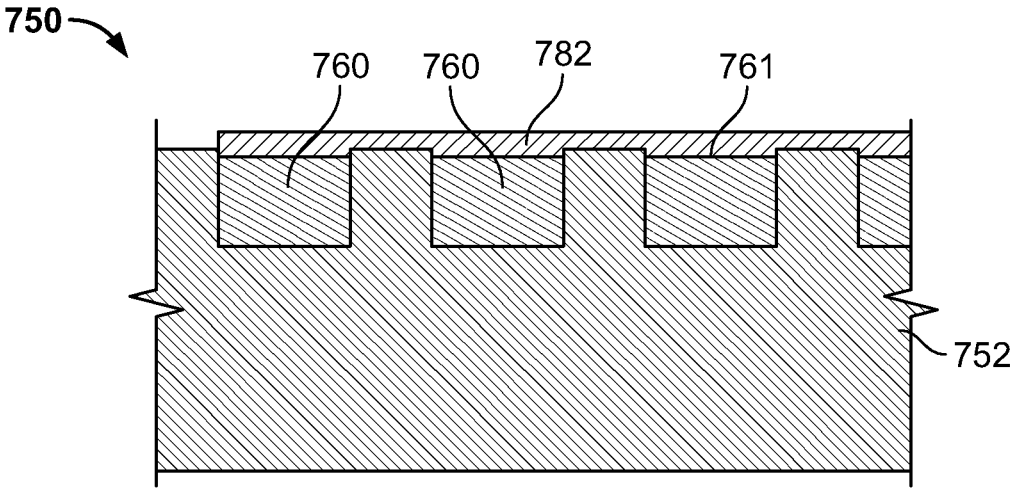
FIG. 35 is a fragmentary, cross-sectional view of the trigger device of FIG. 33 taken along the line 35-35 of FIG. 33.
Figure 36:
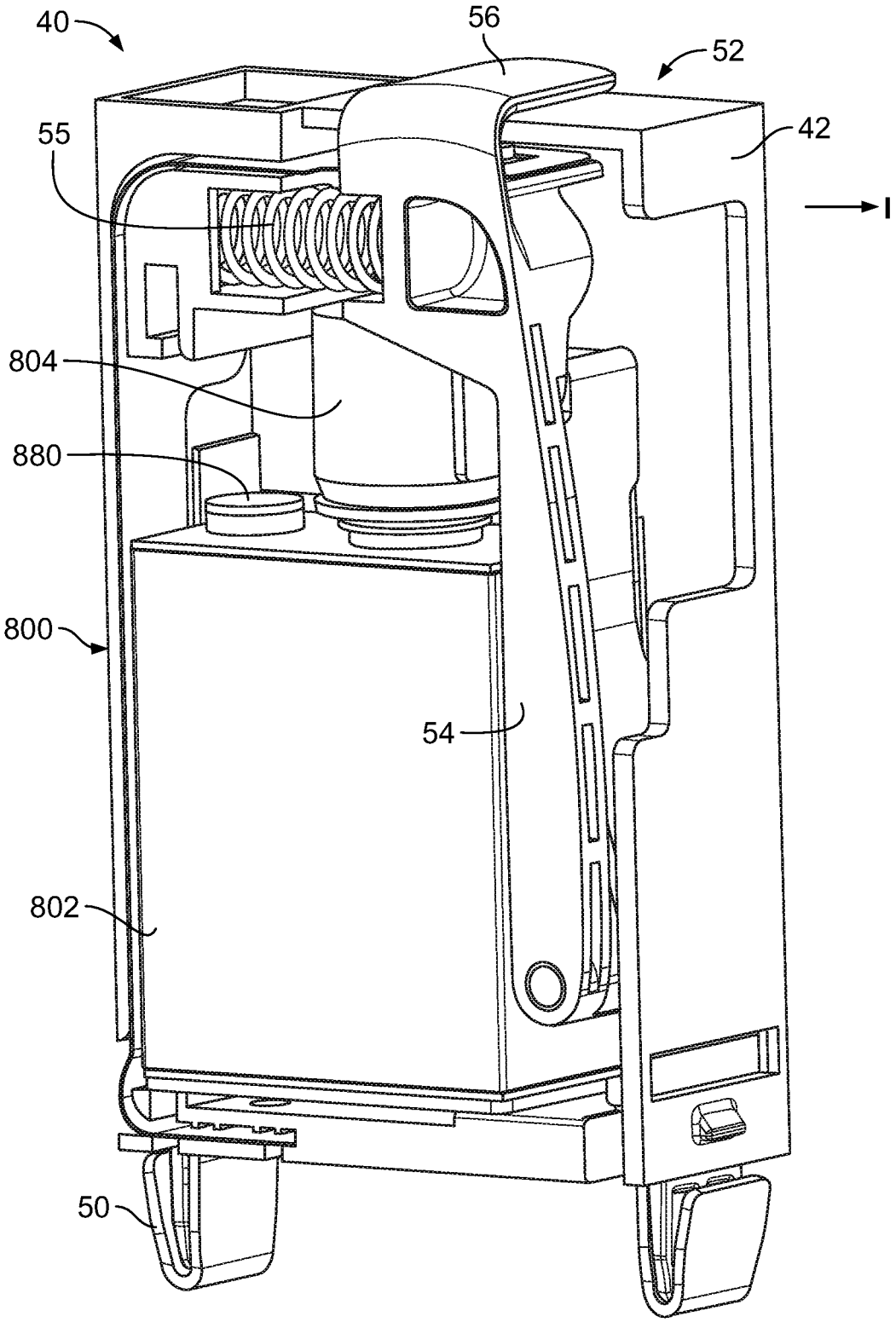
FIG. 36 is a perspective view of an SPD module according to embodiments of the invention, the SPD module including a GDT assembly according to some embodiments.

The primary GDT 804 is embodied in a preassembled module or subassembly 28B. The subassembly 28B is constructed and operates in the same manner as the subassemblies 28 and 28A (FIG. 35), except as follows.

The primary GDT 804 includes a terminal electrode 832, a base electrode 833, an inner post electrode 872, a first or outer bonding layer 819A (e.g., metallization), a second or outer bonding layer 819B (e.g., metallization), a first connection medium 818A (e.g., brazing alloy), a second connection medium 818B (e.g., brazing alloy), a third connection medium 818C (e.g., brazing alloy), an annular first insulator member 877, an annular second insulator member 878, a third annular insulator member 873, and a gas M.

The subassembly 28B can be used and installed on the multi-cell secondary GDT 802 by bonding (e.g., soldering) the base electrode 833 to the outer electrode 835 as described above with regard to the subassembly 28A. For example, the primary GDT 804 may be mechanically and electrically connected to the secondary GDT 802 by soldering the base electrode 833 to the outer electrode 835.

The multi-cell secondary GDT 802 is embodied in a subassembly 29B that includes an outer electrode 835 corresponding to the base electrode 535. The multi-cell secondary GDT 802 is of the same construction and operation as the multi-cell secondary GDT 502, except as follows.

The secondary GDT 802 further includes a housing insulator 810, seals 818 (e.g., brazing alloy), locator members 820, a set E of inner electrodes, a terminal electrode 834, a first trigger end electrode 842, and a second trigger end electrode 844, corresponding to components 110, 118, 120, E, 134, 142, and 144 of the GDT assembly 100.

When the GDT assembly 800 is assembled, the base electrode 833 of the primary GDT 804 is in electrical contact with the outer electrode 835. The outer electrode 835 is in turn in electrical contact with a conductive (e.g., metal) spacer 847. The spacer 847 is in turn in electrical contact with the trigger end electrode 842. The chamber 808 is hermetically sealed by the seals 818 between the outer electrodes 835, 834 and the ends of the housing insulator 810.

It will be appreciated that the GDT assembly 800 thus includes a trigger system 841 that operates in the same manner as the trigger system 141. However, the trigger system 841 differs from the trigger system 141 of the GDT assembly 100 in that the trigger system 841 includes an outer supplemental resistor layer or resistor 864. In some embodiments and as shown, the outer resistor 864 is provided in place of the resistor 164 (i.e., no corresponding outer resistor is provided within the insulator housing on a side of the trigger devices opposite the inner electrodes).

The outer resistor 864 is an elongate layer or strip seated in an outer groove 858 in the exterior surface 810A of the housing insulator 810. The outer resistor 864 has a lengthwise axis J-J, which may be substantially parallel to the lengthwise axis A-A of the secondary GDT 802. The resistor 864 is substantially axially coextensive with the housing insulator 810.

The opposed ends 864A and 864B of the resistor 864 extend beyond the ends of the housing 810 and overlap the terminal electrodes 835 and 834 (corresponding to terminal electrodes 132 and 134, respectively). The outer resistor 864 extends continuously from end 864A to end 864B. The ends 864A and 864B engage and are bonded to the terminal electrodes 835 and 834, respectively, to electrically connect the outer resistor 864 to the terminal electrodes 835 and 834 in the same manner the outer resistor 164 is electrically connected to the terminal electrodes 832 and 834 in the GDT assembly 100.

In use, the outer resistor 864 operates in the same manner as described above for the outer resistor 164 to conduct current between the primary GDT 804 and the terminal electrode 834. However, the outer resistor 864 located outside of the secondary GDT chamber 808 containing the gas M can provide benefits over the resistor 164 located in the chamber 808.

In the case of the resistor 164, it is possible to develop bad contacts between two or more of the terminal electrodes 132, 134, the trigger end electrodes 142, 144, and the metal contacts 170. Gaps may be introduced between these parts during assembly or during surge impulses. These gaps extend the response time of the primary GDT 104 because small sparks must be created to connect the electrical path between the primary GDT and the terminal electrode 132 at the outset of an overvoltage event. Consequently, the effective protection level of the GDT assembly can be too high.

With the outer resistor 864 on the outside of the insulation housing 810 (e.g., ceramic), this problem can be reduced or eliminated. By locating the outer resistor 864 on the insulation housing 810, onto which the electrodes 835 and 832 are affixed, the reliable contact between the outer resistor 864 and the electrodes 835 and 832 can be more easily ensured. As a result, more reliable electrical continuity between the electrodes 835 and 832 through the resistor 864 can be provided.

The outer resistor 864 may be formed of any suitable electrically resistive material. According to some embodiments, the outer resistor 864 is formed of a graphite-based paste or similar material. However, the outer resistor 864 may be formed of any other suitable electrically resistive material.

According to some embodiments, the outer resistor 864 has an electrical resistance in the range of from about 10 to 5000 ohms.

The width and thickness of the outer resistor 864 may depend on the material and desired resistance. According to some embodiments, the outer resistor 864 has a width in the range of from about 1 to 20 mm, and a thickness in the range of from about 0.01 to 0.2 mm.

The outer resistor 864 can be located in any suitable location on the outer surface of the housing 810. More than one outer resistor 864 may be provided on the housing 810.

Outer resistors corresponding to outer resistor 864 can also be incorporated into the GDT assemblies 500, 600.

The multi-cell secondary GDT 802 is also provided with a test gas discharge tube (GDT) 880. The test GDT 880 includes a metal outer test electrode 882, an electrically insulating (e.g., ceramic) ring 884, and a through hole 886 defined in the outer electrode 835. The ring 884 is bonded to the outer electrode 835 over the hole 886 by metallization 883 and brazing alloy 885. The test electrode 882 is bonded to the ring 884 by metallization 883 and brazing alloy 885.

The test electrode 882 and the ring 884 define a test GDT chamber 880A. The test GDT chamber 880A is in fluid communication with the secondary GDT chamber 808. As a result, the gas M contained in the secondary GDT chamber 808 can flow into and out of the test GDT chamber 880A, and the same gas M is thus shared between the chambers 880A, 808.

The test electrode 882 and the outer electrode 835 serve as opposed spark gap terminals to generate a spark across the test GDT chamber 880A. In order to test the secondary GDT 802, an overvoltage is applied across the test GDT 880 and the spark over voltage of the test GDT 880 is measured. This may be accomplished by contacting the two test leads to the test electrode 882 and the outer electrode 835, respectively, and applying the overvoltage across the leads.

The test GDT 880 can solve a practical problem associated with the secondary GDT 802 or similar designs. Because the outer electrodes 835 and 834 are connected in short circuit by the outer resistor 864 (and/or by a resistor 164 (FIG. 2) or equivalent), it is very difficult to check and determine whether the proper gas is contained in the chamber 808. The hole 886 enables the GDT 802 to contain the same gas M in both cells (i.e., the main chamber 808 and the test GDT chamber 880A). According to some embodiments, the measured voltage is between the outer electrode 835 and the test electrode 882. The distance between these electrodes may be about 1 mm.

If the gas in the chambers 808, 880A is not the prescribed gas or a gas mixture within a prescribed acceptable range, the measured spark over voltage of the test GDT 880 will be different than a reference spark over voltage. In particular, if the gas in the test chamber 880A is or includes an excessive amount of ambient air, the measured spark over voltage will be much higher than when the appropriate gas mixture M is contained in the chamber 880A. Ambient air may be introduced into the chamber 808, and thereby the chamber 880A, by a leak in a seal of the GDT assembly 800. The manufacturer can predetermine and assign a prescribed acceptable range of test spark over voltage for the secondary GDT 802. The secondary GDT 802 would then be identified as defective when the measured spark over voltage is outside the prescribed range.

Test GDTs corresponding to the test GDT 880 can also be incorporated into the GDT assemblies 500, 600.

The SPD module 40 further includes a housing 42 within which the GDT assembly 800 is mounted. The housing 42 may take other forms and the module 40 will typically include a cover (not shown) that envelopes the contents of the housing 42, including the GDT assembly 800. In some embodiments, the SPD module 40 is a plug-in module configured to be mounted in a base (not shown).

The SPD module 40 includes an electrical conductive (e.g., metal) terminal member 50. The terminal member 50 includes contact portion or plate 50B and an integral first contact terminal 50A. The contact portion or plate 50B engages the outer terminal 834. The contact terminal 50A extends from the housing 42.

The SPD module 40 further includes a thermal disconnect mechanism 44. The thermal disconnect mechanism 44 includes an electrically conductive spring 46 that is secured at one end by a contact portion 46B to the primary GDT electrode 832 by meltable solder 48. The other end of the spring 46 includes an integral terminal contact 46A of the module 40. When the GDT assembly 800 fails (e.g., the multi-cell secondary GDT 802 short-circuits internally), the primary GDT 804 will quickly heat up until the solder 48 melts sufficiently to release the spring contact 46B, which is spring biased or loaded away from the terminal electrode 832. The GDT assembly 800 is thereby disconnected from the line connected to the terminal contact 46A.

Figure 37:
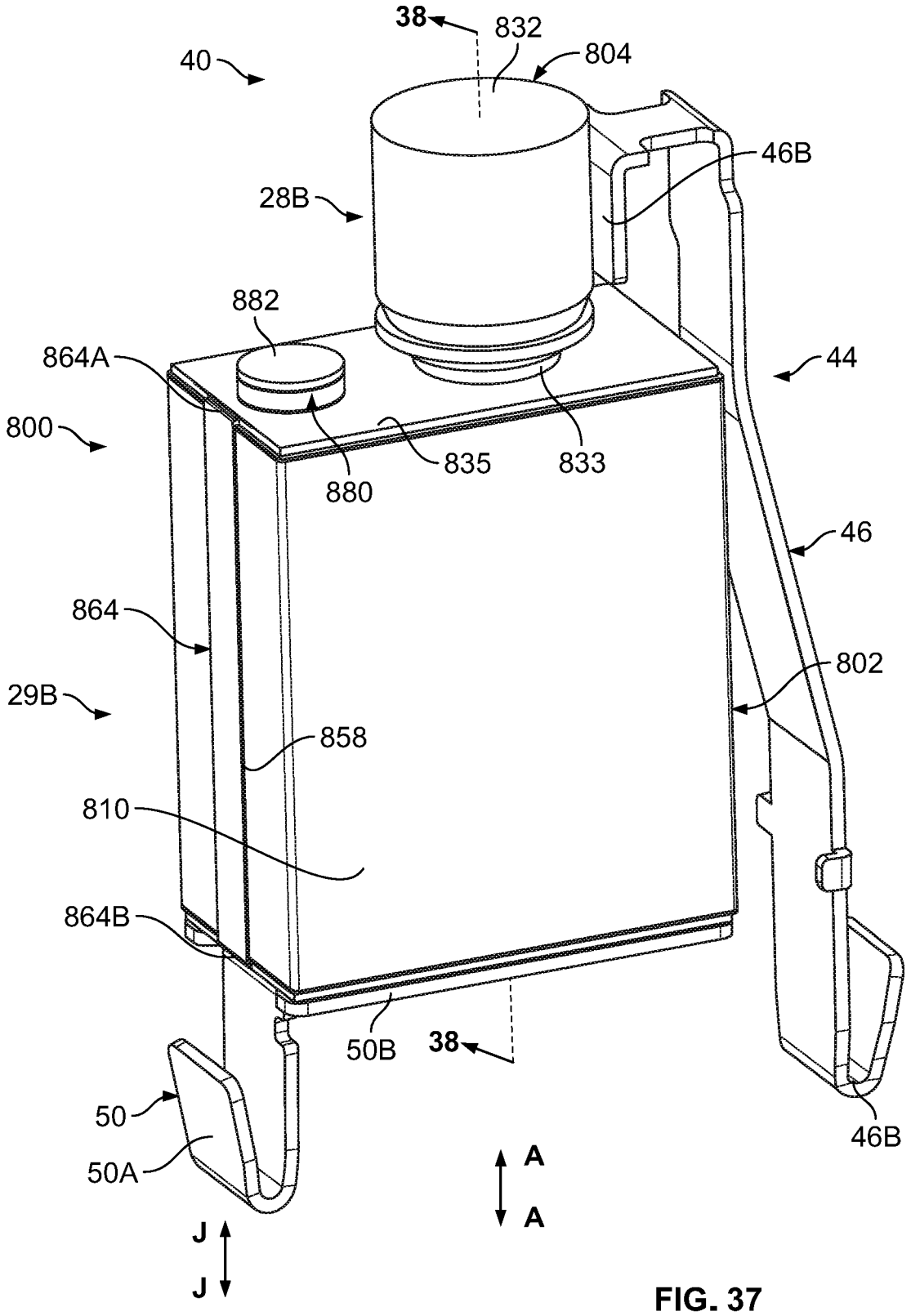
FIG. 37 is a fragmentary, perspective view of the SPD module of FIG. 36.
Figure 38:
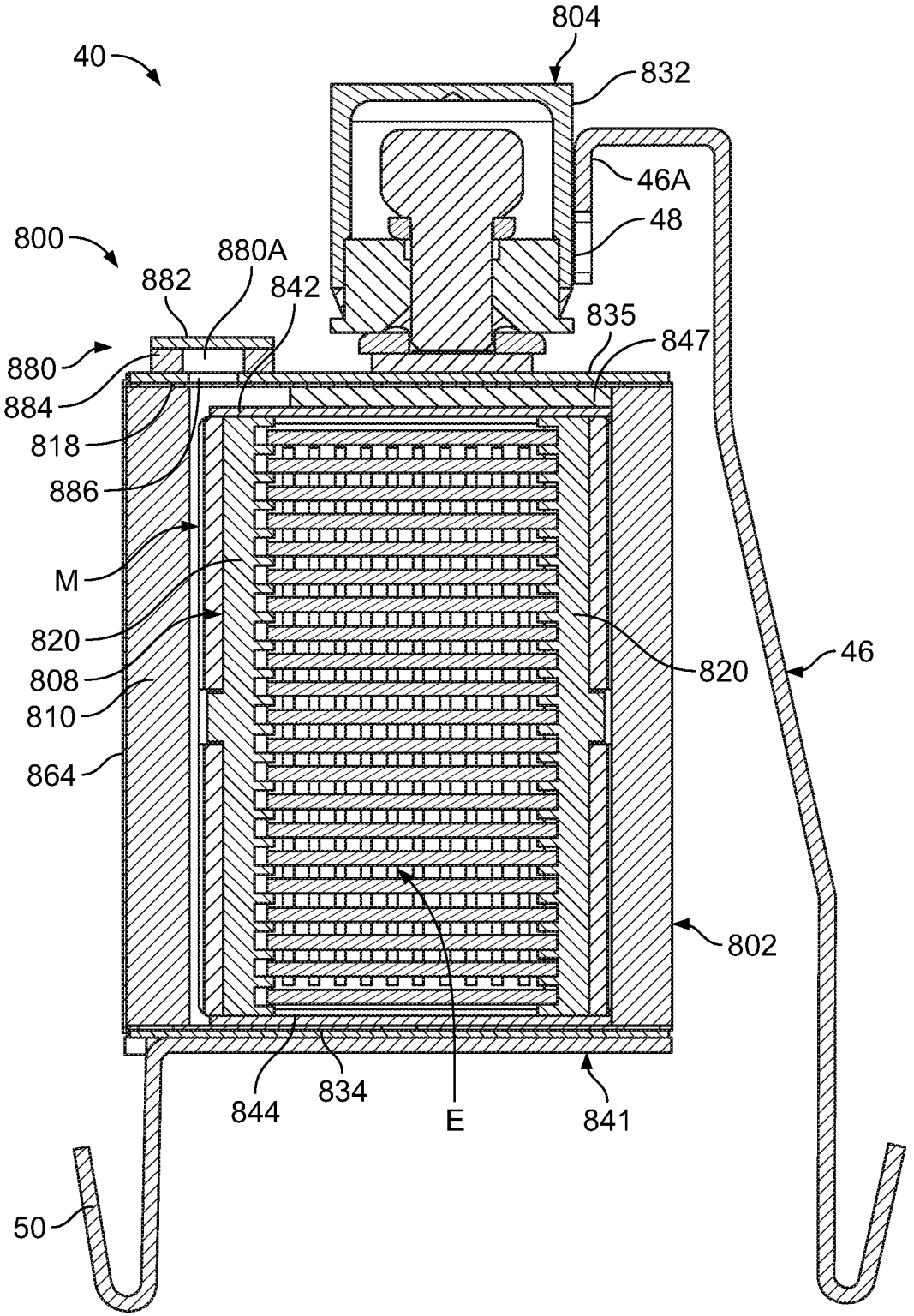
FIG. 38 is a cross-sectional view of the SPD module of FIG. 36 taken along the line 38-38 of FIG. 37.
Figure 39:
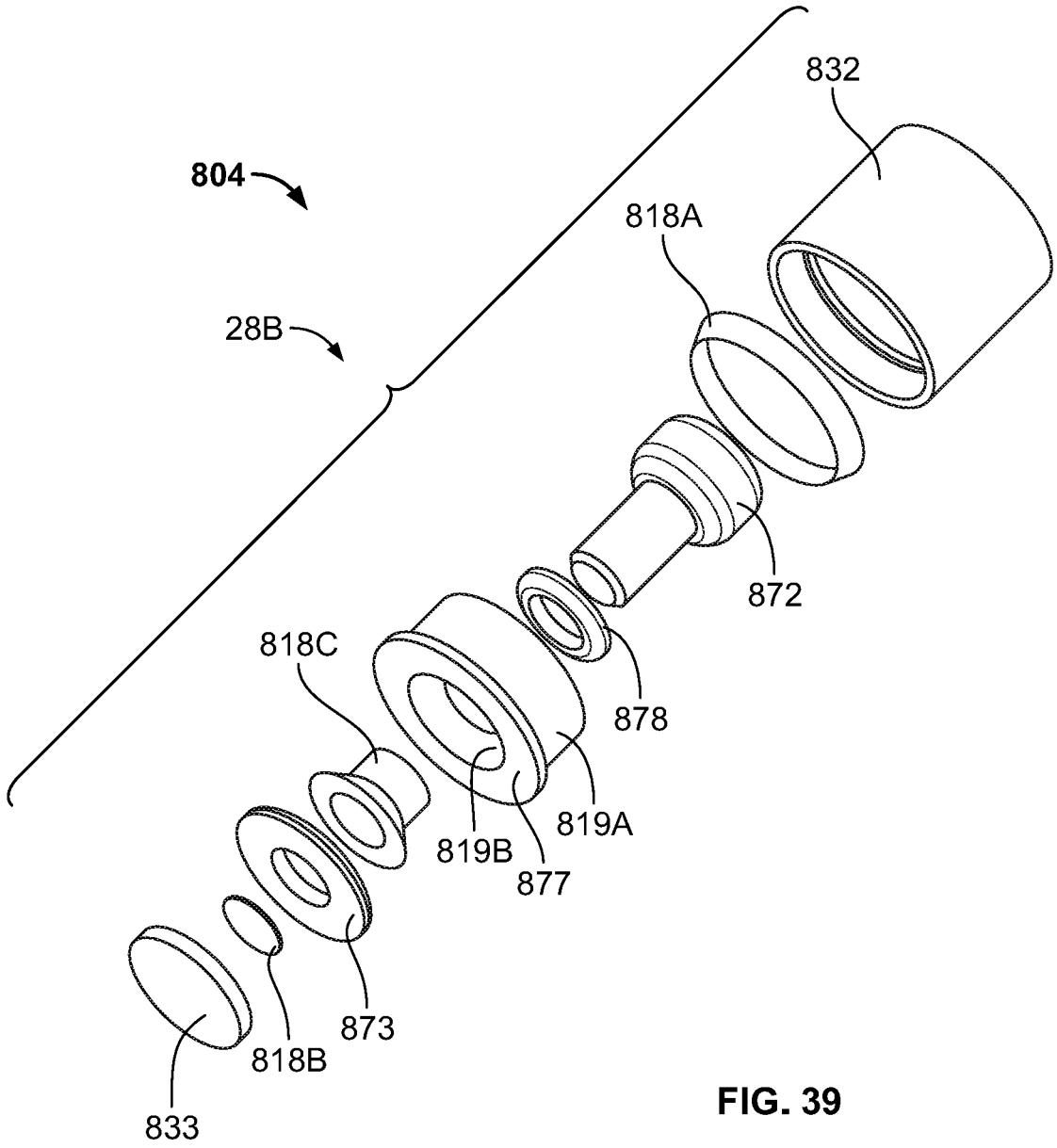
FIG. 39 is an exploded, perspective view of a primary GDT forming a part of the GDT assembly of FIG. 36.
Figure 40:
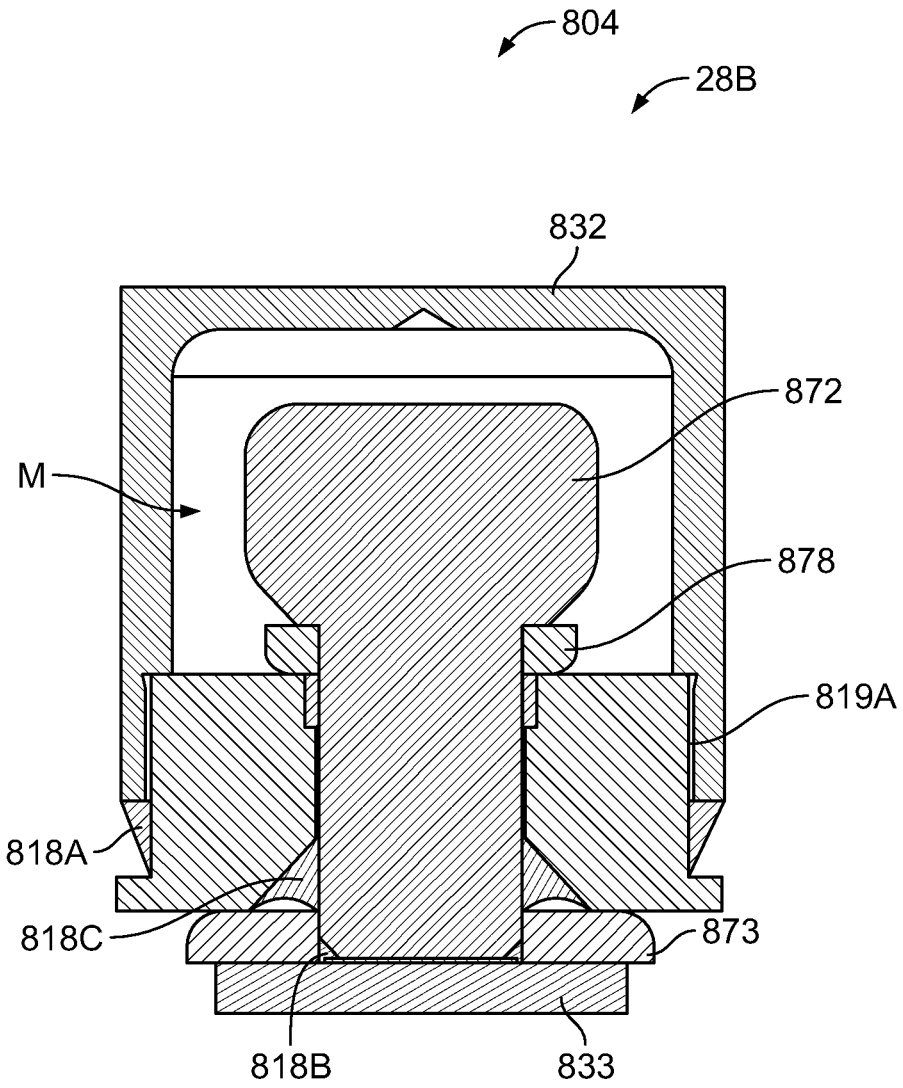
FIG. 40 is a cross-sectional view of the primary GDT of FIG. 39 taken along the line 38-38 of FIG. 37.
Figure 41:
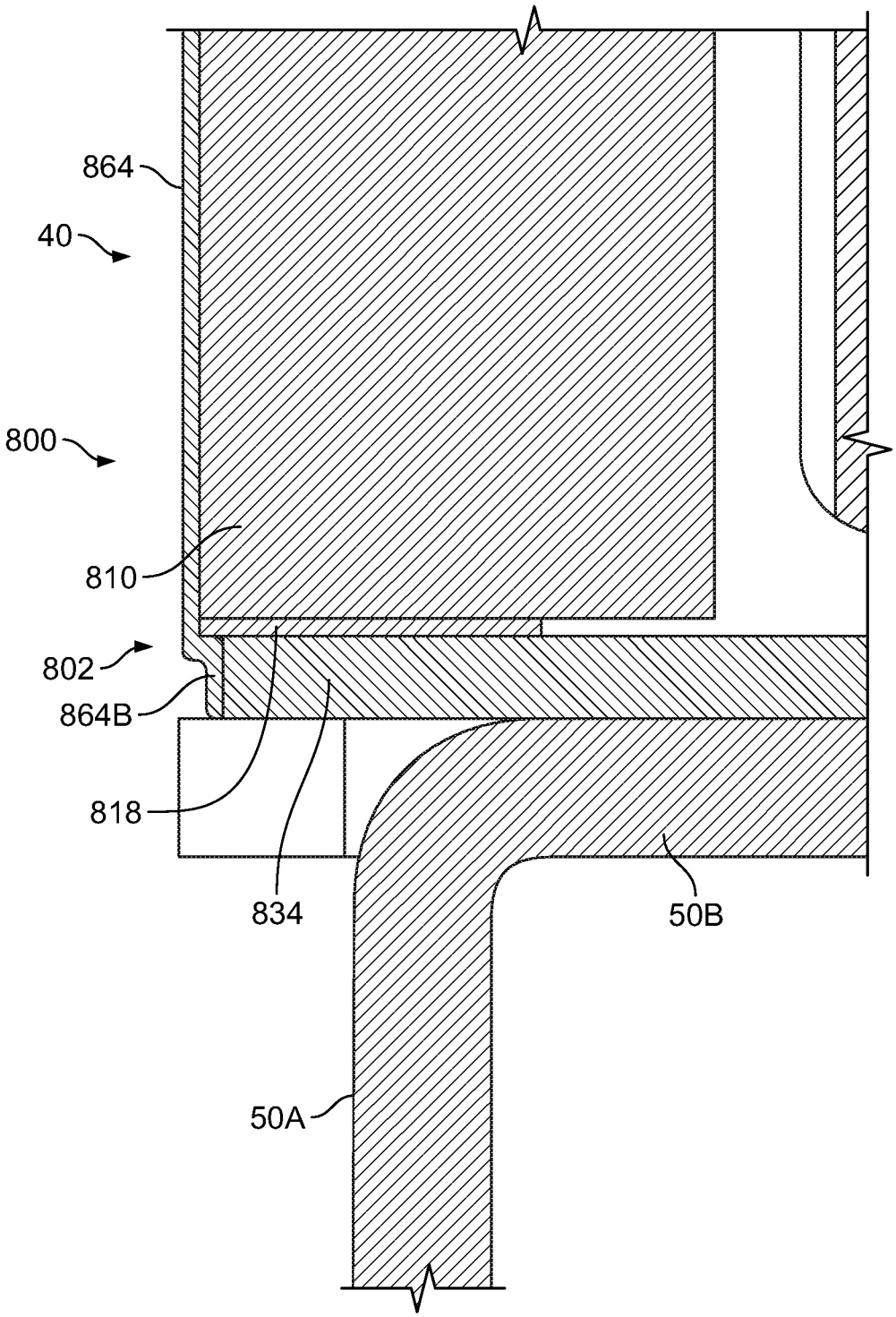
FIG. 41 is an enlarged, fragmentary, cross-sectional view of the SPD module of FIG. 36 taken along the line 38-38 of FIG. 37.
Figure 42:
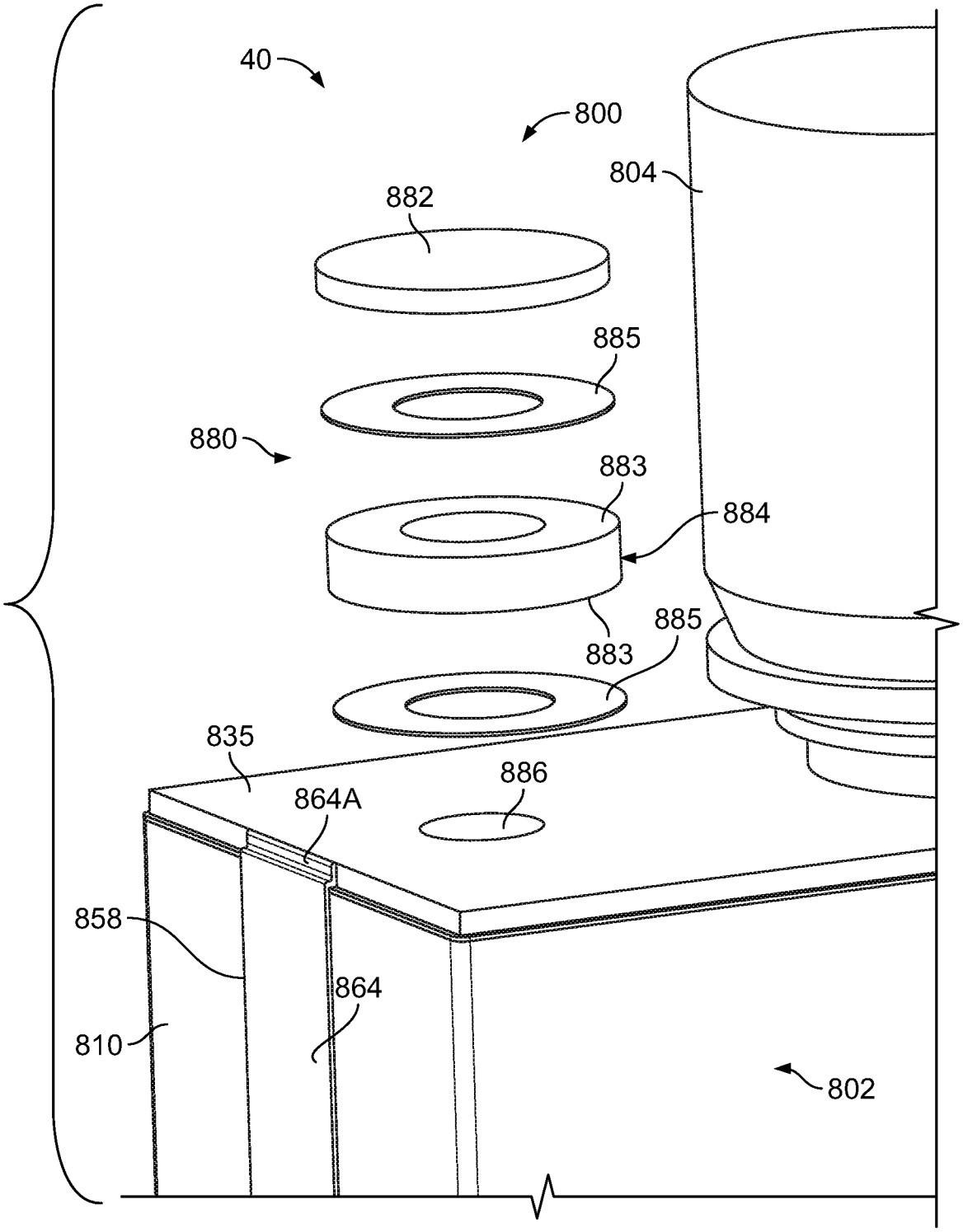
FIG. 42 is an enlarged, fragmentary, perspective view of the GDT assembly of FIG. 36.

The SPD module 40 also includes a failure indicator mechanism 52. The failure indicator mechanism 52 includes a swing arm 54, a biasing feature (e.g., a spring) 55, and an indicator member 56. The spring 55 tends to force the swing arm, and thereby the indicator 56, in a direction I away from a ready position (when the contact portion 46B is secured by the solder 48 to the electrode 832; as shown in FIG. 37) toward a triggered position that indicates to an observer that the module 40 has failed. The swing arm 54 is held in the ready position by the secured spring 46, and released by the spring 46 when the spring is released from the electrode 832 by overheating of the electrode 832.

While the GDT assemblies (e.g., GDT assemblies 100-600 and 800) have been shown and described herein having certain numbers of inner electrodes (e.g., electrodes E1-E21), GDT assemblies according to embodiments of the invention may have more or fewer inner electrodes. According to some embodiments, a GDT assembly as disclosed herein has at least two inner electrodes defining at least three spark gaps G and, in some embodiments, or at least three inner electrodes defining at least four spark gaps G. According to some embodiments, a GDT assembly as disclosed herein has in the range of from 2 to 40 (or more) inner electrodes. The number of inner electrodes provided may depend on the continuous operating voltage the GDT assembly is intended to experience in service.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

What is claimed is:

1. A gas discharge tube assembly comprising:

a multi-cell gas discharge tube (GDT) including:

a housing defining a GDT chamber;

a plurality of inner electrodes located in the GDT chamber;

a trigger resistor located in the GDT chamber; and a gas contained in the GDT chamber;

wherein the inner electrodes are serially disposed in the chamber in spaced apart relation to define a series of cells and spark gaps; and wherein:

the trigger resistor includes an interface surface exposed to at least one of the cells; and the trigger resistor is responsive to an electrical surge through the trigger resistor to generate a spark along the interface surface and thereby promote an electrical arc in the at least one cell.

2. The gas discharge tube assembly of claim 1 wherein:

the multi-cell GDT includes first and second trigger end electrodes;

the series of cells and spark gaps extends from the first trigger end electrode to the second trigger end electrode; and the trigger resistor electrically connects the first trigger end electrode to the second trigger end electrode.

3. The gas discharge tube assembly of claim 2 wherein the trigger resistor is exposed to a plurality of the cells and is responsive to an electrical surge through the trigger resistor to generate sparks along the interface surface and thereby promote electrical arcs in the plurality of the cells.

4. The gas discharge tube assembly of claim 2 wherein:

the multi-cell GDT has a main axis and the inner electrodes and the first and second trigger end electrodes are spaced apart along the main axis; and the trigger resistor is configured as an elongate strip extending along the main axis.

5. The gas discharge tube assembly of claim 4 wherein:

the multi-cell GDT includes a plurality of the trigger resistors extending along the main axis and each having an interface surface; and each of the trigger resistors is exposed to a plurality of the cells and is responsive to an electrical surge through the trigger resistor to generate sparks along the interface surface thereof and thereby promote electrical arcs in the plurality of the cells.

6. The gas discharge tube assembly of claim 4 including a trigger device, wherein the trigger device includes:

a trigger device substrate including an axially extending groove defined therein; and the trigger resistor, wherein the trigger resistor is disposed in the groove such that the interface layer is exposed.

7. The gas discharge tube assembly of claim 6 wherein:

the trigger device substrate includes a plurality axially extending, substantially parallel grooves defined therein; and the trigger device includes a plurality of the trigger resistors each disposed in a respective one of the grooves.

8. The gas discharge tube assembly of claim 2 further including an outer resistor that:

electrically connects the first trigger end electrode to the second trigger end electrode; and is not exposed to the cells.

9. The gas discharge tube assembly of claim 8 wherein the outer resistor is mounted on an exterior of the housing.

10. The gas discharge tube assembly of claim 1 wherein:

the trigger resistor includes an inner surface facing the inner electrodes and including the interface surface; and the gas discharge tube assembly further includes an electrically insulating resistor protection layer bonded to the inner surface between the inner surface and the inner electrodes.

11. The gas discharge tube assembly of claim 1 including an integral primary GDT connected in series with the multi-cell GDT, wherein the primary GDT is operative to conduct current in response to an overvoltage condition across the gas discharge tube assembly and prior to conduction of current across the plurality of spark gaps of the multi-cell GDT.

12. The gas discharge tube assembly of claim 11 wherein the primary GDT is electrically connected to the trigger resistor such that current is conducted through the trigger resistor when the primary GDT conducts current.

13. The gas discharge tube assembly of claim 11 wherein:

the primary GDT is located in the GDT chamber; and the GDT chamber is hermetically sealed.

14. The gas discharge tube assembly of claim 11 wherein:

the GDT chamber is hermetically sealed;

the primary GDT includes a primary GDT chamber that is hermetically sealed from the GDT chamber; and the primary GDT chamber contains a primary GDT gas that is different from the gas in the GDT chamber.

15. The gas discharge tube assembly of claim 1 wherein the GDT chamber is hermetically sealed.

16. The gas discharge tube assembly of claim 1 wherein the housing includes:

a tubular housing insulator; and at least one reinforcement member positioned in the housing insulator between the inner electrodes and the housing insulator.

17. The gas discharge tube assembly of claim 16 wherein:

the at least one reinforcement member includes a plurality of locator slots; and the inner electrodes are each seated in a respective one of the locator slots such that the inner electrodes are thereby held in axially spaced apart relation and are able to move laterally a limited displacement distance.

18. The gas discharge tube assembly of claim 1 wherein the inner electrodes are substantially flat plates.

19. The gas discharge tube assembly of claim 1 wherein the trigger resistor is formed of a material having a specific electrical resistance in the range of from about 0.1 micro-ohm-meter to 10,000 ohm-meter.

20. The gas discharge tube assembly of claim 1 wherein the trigger resistor has an electrical resistance in the range of from about 0.1 ohm to 100 ohms.

21. The gas discharge tube assembly of claim 1 wherein the interface surface of the trigger resistor is nonhomogeneous and porous.

22. The gas discharge tube assembly of claim 1 wherein:

the multi-cell GDT has a main axis and the inner electrodes are spaced apart along the main axis;

the trigger resistor extends along the main axis;

a plurality of laterally extending, axially spaced apart surface grooves are defined in the interface surfaces of the trigger resistor; and the surface grooves do not extend fully through a thickness of the trigger resistor, so that a remainder portion of the trigger resistor is present at the base of each surface groove and provides electrical continuity throughout a length of the trigger resistor.

23. The gas discharge tube assembly of claim 22 wherein each surface groove has an axially extending width in the range of from about 0.2 mm to 1 mm.

24. The gas discharge tube assembly of claim 1 including a thermal disconnect mechanism responsive to heat generated in the gas discharge tube assembly to disconnect the gas discharge tube assembly from a circuit.

25. The gas discharge tube assembly of claim 1 including an integral test gas discharge tube (GDT), the test GDT including:

a test GDT electrode; and a test GDT chamber in fluid communication with the GDT chamber to permit flow of the gas between the GDT chamber and the test GDT chamber.

* * * * *